US007887425B2

(12) United States Patent
Nakanishi

(10) Patent No.: US 7,887,425 B2
(45) Date of Patent: Feb. 15, 2011

(54) BALANCE TRAINING APPARATUS

(75) Inventor: Ryusuke Nakanishi, Nagoya (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 762 days.

(21) Appl. No.: 11/764,971

(22) Filed: Jun. 19, 2007

(65) Prior Publication Data

US 2007/0298395 A1 Dec. 27, 2007

(30) Foreign Application Priority Data

Jun. 21, 2006 (JP) ..... 2006-171524

(51) Int. Cl.
*A63G 13/06* (2006.01)

(52) U.S. Cl. ..... 472/97; 472/95; 472/96; 434/247; 434/258; 482/51; 482/142

(58) Field of Classification Search ..... 434/247, 434/258; 472/95, 96, 97; 482/51, 133, 136, 482/142, 145
See application file for complete search history.

(56) References Cited

U.S. PATENT DOCUMENTS

| | | | | |
|---|---|---|---|---|
| 3,997,979 | A * | 12/1976 | Turner | 472/29 |
| 4,662,493 | A * | 5/1987 | Aoki et al. | 477/168 |
| 4,988,300 | A | 1/1991 | Yamaguchi et al. | |
| 5,755,650 | A * | 5/1998 | Urso | 482/138 |
| 7,121,831 | B2 | 10/2006 | Hojo et al. | |
| 2002/0115536 | A1 * | 8/2002 | Hojo et al. | 482/51 |
| 2004/0166938 | A1 * | 8/2004 | Hojo et al. | 463/36 |
| 2004/0198553 | A1 * | 10/2004 | Hojo et al. | 482/1 |
| 2006/0025226 | A1 * | 2/2006 | Nakano et al. | 472/97 |
| 2006/0073939 | A1 | 4/2006 | Nakanishi | |

FOREIGN PATENT DOCUMENTS

| | | |
|---|---|---|
| EP | 1621236 | 2/2006 |
| GB | 688538 | 3/1953 |
| GB | 2420724 | 6/2006 |
| JP | 2006-61672 | 3/2006 |

OTHER PUBLICATIONS

English language Abstract of JP 2006-61672.
U.S. Appl. No. 11/753,166 to Nakanishi, filed May 24, 2007.
U.S. Appl. No. 11/763,066 to Nakanishi, filed Jun. 14, 2007.

* cited by examiner

*Primary Examiner*—Gene Kim
*Assistant Examiner*—Joseph B Baldori
(74) *Attorney, Agent, or Firm*—Greenblum & Bernstein P.L.C.

(57) ABSTRACT

Disclosed is a balance training apparatus for applying an exercise load to a subject, which comprises a seat adapted to allow the subject to sit thereon, a rocking mechanism for rockingly moving the seat, and a phase changer. The rocking mechanism includes a plurality of converters adapted to receive a driving force transmitted from a common driving source so as to operate in an interlocked relationship with each other, and convert the driving force from the driving source to a rocking motion having movement directions intersecting with each other. The phase changer is adapted to selectively connect and disconnect the transmission of the driving force to first converter consisting of a part of the plurality of converter, so as to change a phase relationship in rocking motion between the first converter, and second converter consisting of the rest of the plurality of converter. The seat with a subject thereon can be mockingly moved in a variety of rocking patterns according to variously changed phase relations.

4 Claims, 33 Drawing Sheets

BALANCE TRAINING APPARATUS

BACKGROUND OF THE INVENTION

1. Field of the Invention

The present invention relates to a balance training apparatus designed to rockingly move a seat with a subject thereon so as to apply an exercise load simulating horseback riding to the subject to facilitate the training of his/her balance abilities.

2. Description of the Related Art

A balance training apparatus is designed to rockingly move a seat with a subject thereon so as to apply an exercise load simulating horseback riding to the subject to facilitate the training of his/her balance abilities. The balance training apparatus has been increasingly prevalent among general households as well as among health care facilities for the original purpose of rehabilitation. As a typical example of the conventional balance training apparatus, there has been known a technique as disclosed, for example, in Japanese Patent Unexamined Publication 2006-61672, which is proposed by the applicant of this application. This Patent Publication discloses a compact-structured rocking mechanism housed below a seat.

While the rocking mechanism disclosed in the Patent Publication has a compact structure which contributes to cost reduction of the apparatus, a seat rocking pattern based on the rocking mechanism is limited to only a single motion where the seat is rockingly moved along a horizontal figure-of-eight shaped locus in top plan view. Therefore, as a subject becomes more skillful, he/she might not be completely satisfied with such a monotonous rocking patter.

SUMMARY OF THE INVENTION

It is an object of the present invention to provide a balance training apparatus which can provide a variety of rocking motions.

According to an aspect of the invention, a balance training apparatus is adapted for applying an exercise load to a subject. The balance training apparatus comprises a seat adapted to allow the subject to sit thereon, a rocking mechanism for rockingly moving the seat, and a phase changer. The rocking mechanism includes a plurality of converters adapted to receive a driving force transmitted from a common driving source so as to operate in an interlocked relationship with each other, and convert the driving force from the driving source to a rocking motion having movement directions intersecting with each other. The phase changer is adapted to selectively connect and disconnect the transmission of the driving force to first converter consisting of a part of the plurality of converter, so as to change a phase relationship in rocking motion between the first converter, and second converter consisting of the rest of the plurality of converter. Based on this features, the seat with a subject thereon is rockingly moved in a variety of rocking patterns according to variously changed phase relations.

A phase of the first converter can be changed to provide a variety of rocking motions while adequately adjusting a rocking locus of the seat and an allocation of physical exercise (allocation of the rocking motions depending on a target muscle and a desired training level or exercise intensity). This makes it possible to achieve a highly user-friendly balance training apparatus capable of keeping subjects interested to facilitate a continuing use.

These and other objects, features and advantages of the invention will become more apparent upon reading the following detailed description along with the accompanying drawings.

DESCRIPTION OF THE PREFERRED EMBODIMENTS OF THE INVENTION

With reference to the drawings, a preferred embodiment of the present invention will be specifically described.

Figure 1:
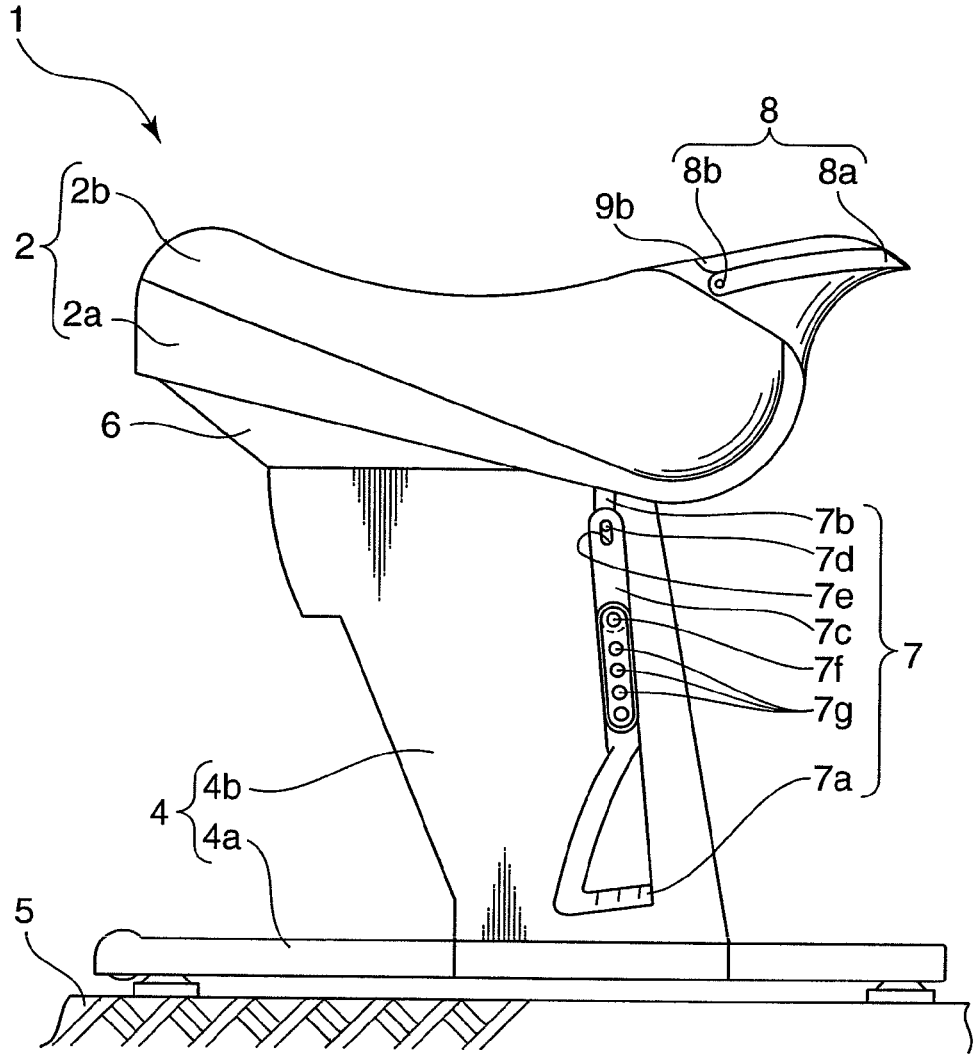
FIG. 1 is a side view showing an overall structure of a balance training apparatus according to an embodiment of the present invention.
Figure 2:
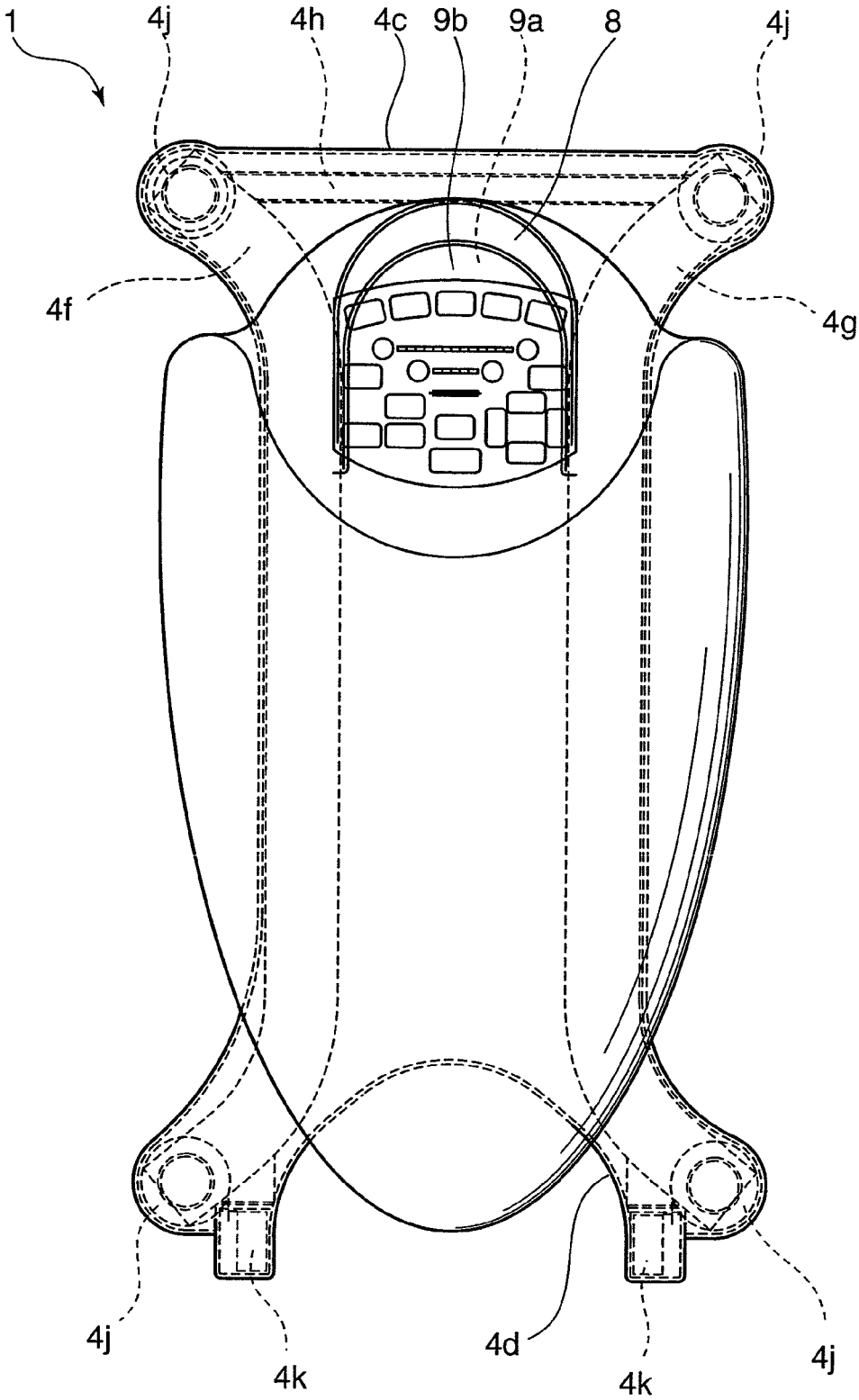
FIG. 2 is a top plan view of the balance training apparatus shown in FIG. 1.
Figure 3:
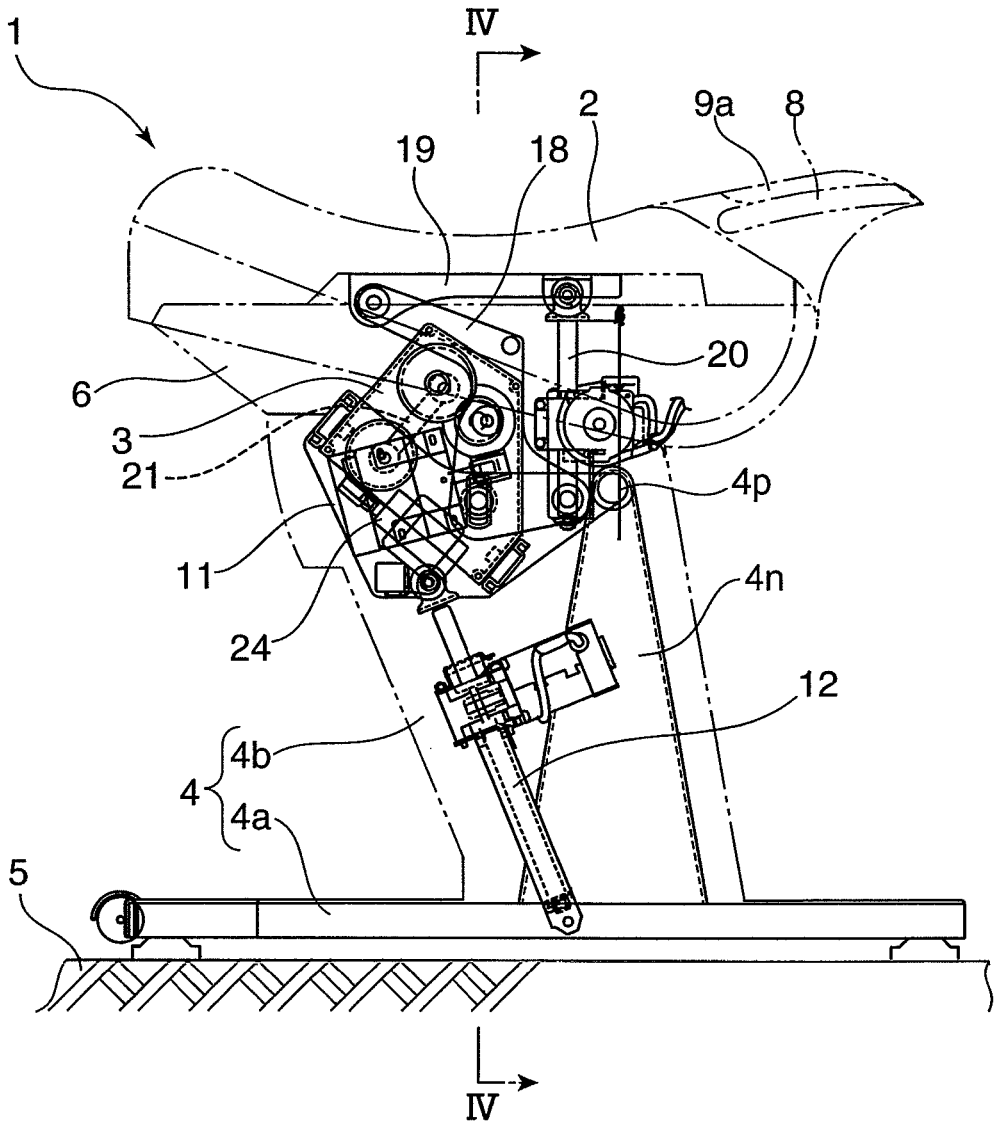
FIG. 3 is a side view of the balance training apparatus shown in FIG. 1
Figure 4:
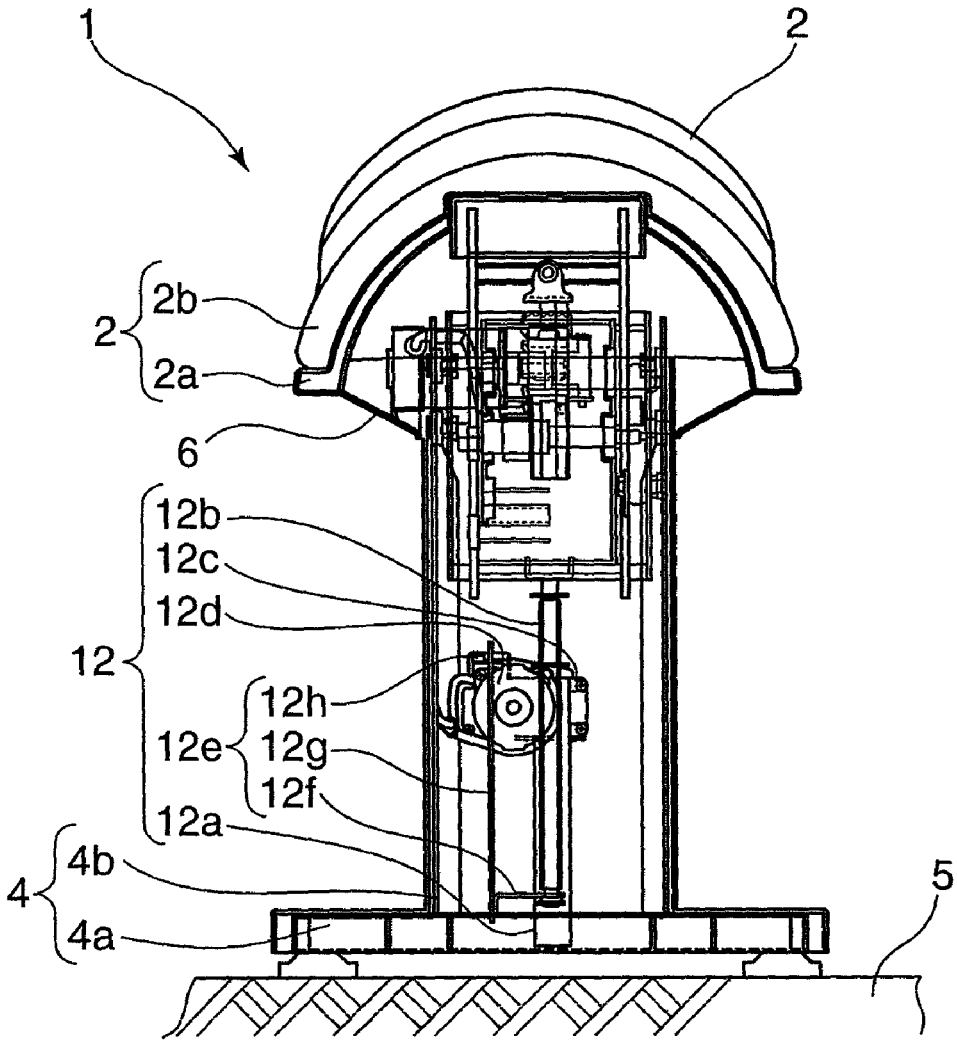
FIG. 4 is a sectional view taken along the line IV-IV in FIG. 3.
Figure 5:
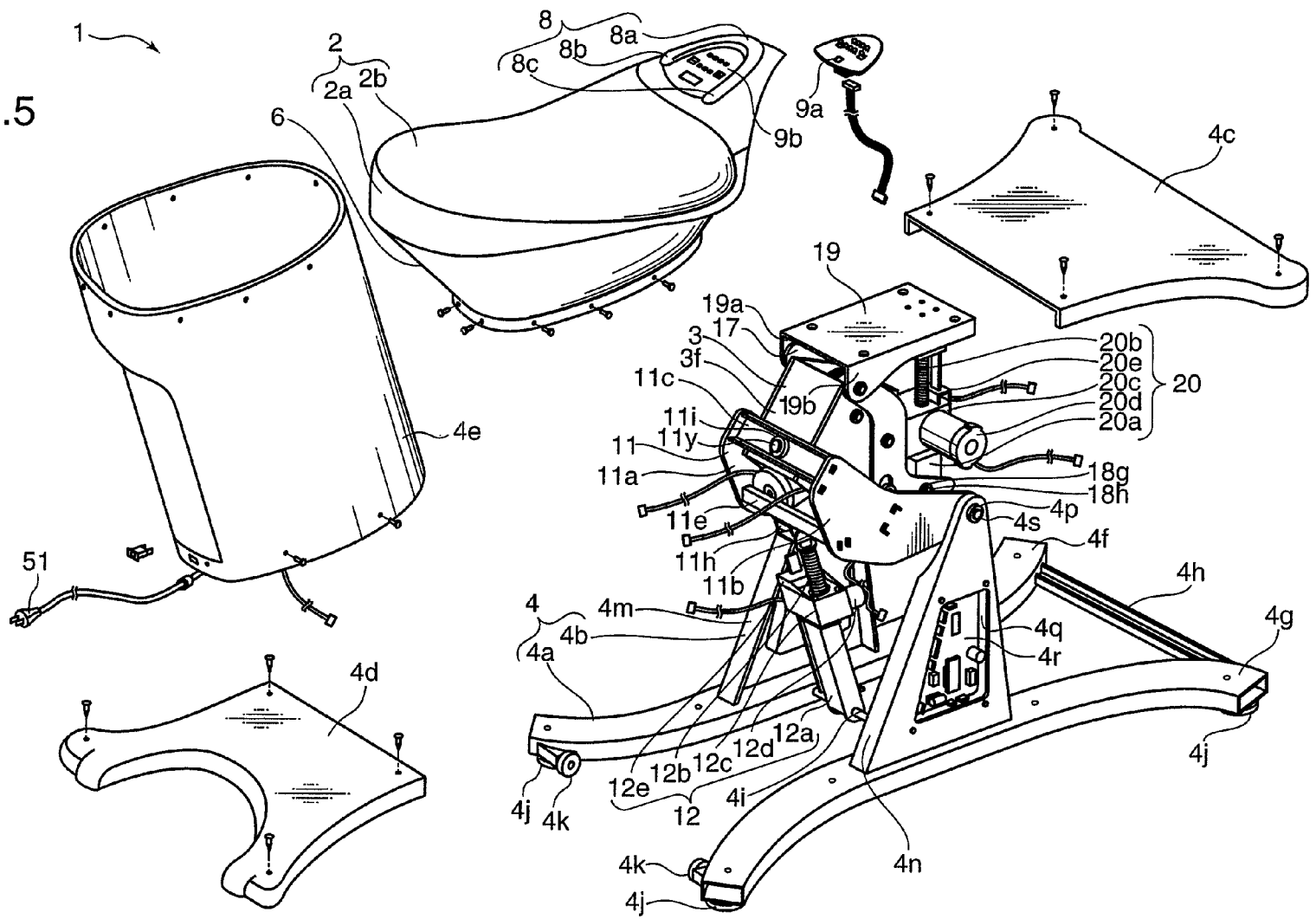
FIG. 5 is an exploded perspective view of the balance training apparatus shown in FIG. 1, when viewed from a right rear side thereof.

FIG. 1 is a side view showing an overall structure of a balance training apparatus 1 according to an embodiment of the present invention. FIGS. 2 and 3 are a top plan view and a side view of the balance training apparatus 1, respectively. FIG. 4 is a sectional view taken along the line IV-IV in FIG. 3, and FIG. 5 is an exploded perspective view of the balance training apparatus 1. This balance training apparatus 1 generally comprises a seat 2 formed in a shape simulating a horseback or a saddle and adapted to allow a subject (i.e., user) to sit thereon, a rocking mechanism 3 provided in the seat 2 and adapted to rockingly move the seat 2, and a leg 4 supporting the seat 2 and the rocking mechanism 3. The seat 2 is prepared by laminating a cushion pad 2*b* on a seat base 2*a* to be attached to the rocking mechanism 3.

A pair of stirrups 7 are attached, respectively, to front regions of opposite lateral surfaces of the seat 2 in such a manner as to hang therefrom (the stirrups 7 are omitted in FIGS. 2 to 5 only for the purpose of simplifying illustration). Each of the stirrups 7 includes a foot hold member 7*a* for allowing the subject to put his/her foot thereon, an anchor member 7*b* fixedly fastened to the seat base 2*a* with a screw, and a connection member 7*c* connecting the foot hold member 7*a* and the anchor member 7*b*. The connection member 7*c* is formed with a hole 7*e* in an upper end thereof, and the anchor member 7*b* is provided with a pin 7*d* protruding from a lower end thereof laterally outwardly. The pin 7*d* is fitted into the hole 7*e* so that the connection member 7*c* is swingably connected to the anchor member 7*b*. Further, the connection member 7*c* is provided with a pin 7*f* protruding from a lower end thereof laterally outwardly, and the foot hold member 7*a* is formed with a plurality of holes 7*g* in an upper end thereof. The pin 7*f* is fitted into any one of the holes 7*g* so that the foot hold member 7*a* is connected to the connection member 7*c* while allowing a length of the stirrup 7 (i.e., a height position of the foot hold member 7*a*) to be adjusted.

The seat 2 is provided with a rein 8 on a front portion thereof. This rein 8 includes a semicircular arc-shaped handle 8*a* which has right and left ends 8*c*, 8*b* each folded inwardly (in a direction of a diametral line thereof) and pivotally attached onto the front portion of the seat 2, so that a farthermost portion of the handle 8*a* relative to the subject can be turned up from the seat 2 when used, and then turned back to its original storage position after use.

The front portion of the seat 2 is provided with a manipulation unit which comprises a concaved support base formed in an inward region relative to the rein 8 in the storage position, a manipulator circuit board 9*a* mounted on the support base and surrounded by a manipulator case and a front panel 9*b* covering an upper surface of the manipulator case.

The leg 4 comprises a leg base 4*a* placed on a floor 5, a leg column 4*b* extending upwardly from the leg base 4*a*, front and rear covers 4*c*, 4*d* each covering a corresponding one of front and rear regions of the leg base 4*a*, and a column cover 4*e* covering the leg column 4*b*. The leg base 4*a* generally includes right and left frames 4*g*, 4*f*, a connection frame 4*h* connecting respective front ends of the right and left frames 4*g*, 4*f*, and a connection bar 4*i* connecting respective longitudinally-central portions of the right and left frames 4*g*, 4*f*. A screwed-type stand member 4*j* is attached to each of the front and rear ends of the right and left frames 4*g*, 4*f* to adequately adjust a height position of the apparatus depending on conditions of the floor 5. Further, a caster 4*k* is attached to each of the rear ends of the right and left frames 4*g*, 4*f* at a predetermined height position.

Thus, each of the stand members 4*j* at the rear ends of the right and left frames 4*g*, 4*f* is adjusted to lower a protruding height thereof, so that the balance training apparatus 1 can be slidingly moved along the floor 5 while lifting the connection frame 4*h* at the front ends of the right and left frames 4*g*, 4*f*. Further, each of the stand members 4*j* at the rear ends of the right and left frames 4*g*, 4*f* is adjusted to have a protruding height greater than that of the caster 4*k*, so that the balance training apparatus 1 can be maintained in a horizontal position without any displacement relative to the floor 5, and the rocking mechanism 3 and the seat 2 can be stably supported even when the seat 2 is being rockingly moved with the subject sitting thereon.

In order to support a load of the rocking mechanism 3, the seat 2 and the subject, the leg column 4*b* comprises a pair of right and left pillars 4*n*, 4*m* formed in an approximately triangular shape in side view. Each of the right and left pillars 4*n*, 4*m* has a base portion fixed to an approximately central portion of a corresponding one of the right and left frames 4*g*, 4*f*, and an apex portion to which a bearing 4*p* is fittingly fixed. Further, in at least one of the right and left pillars 4*n*, 4*m*, a concave portion 4*q* is formed in a central region of the rectangular shape. The concave portion 4*q* receives therein a main-unit circuit board 4*r* adapted to perform a power supply control and a drive control for the balance training apparatus 1. The components of the leg column 4*b* are covered by the column cover 4*e*, and a space between an upper edge of the column cover 4*e* and a bottom surface of the seat base 2*a* is covered by a stretchable cover 6.

Figure 6:
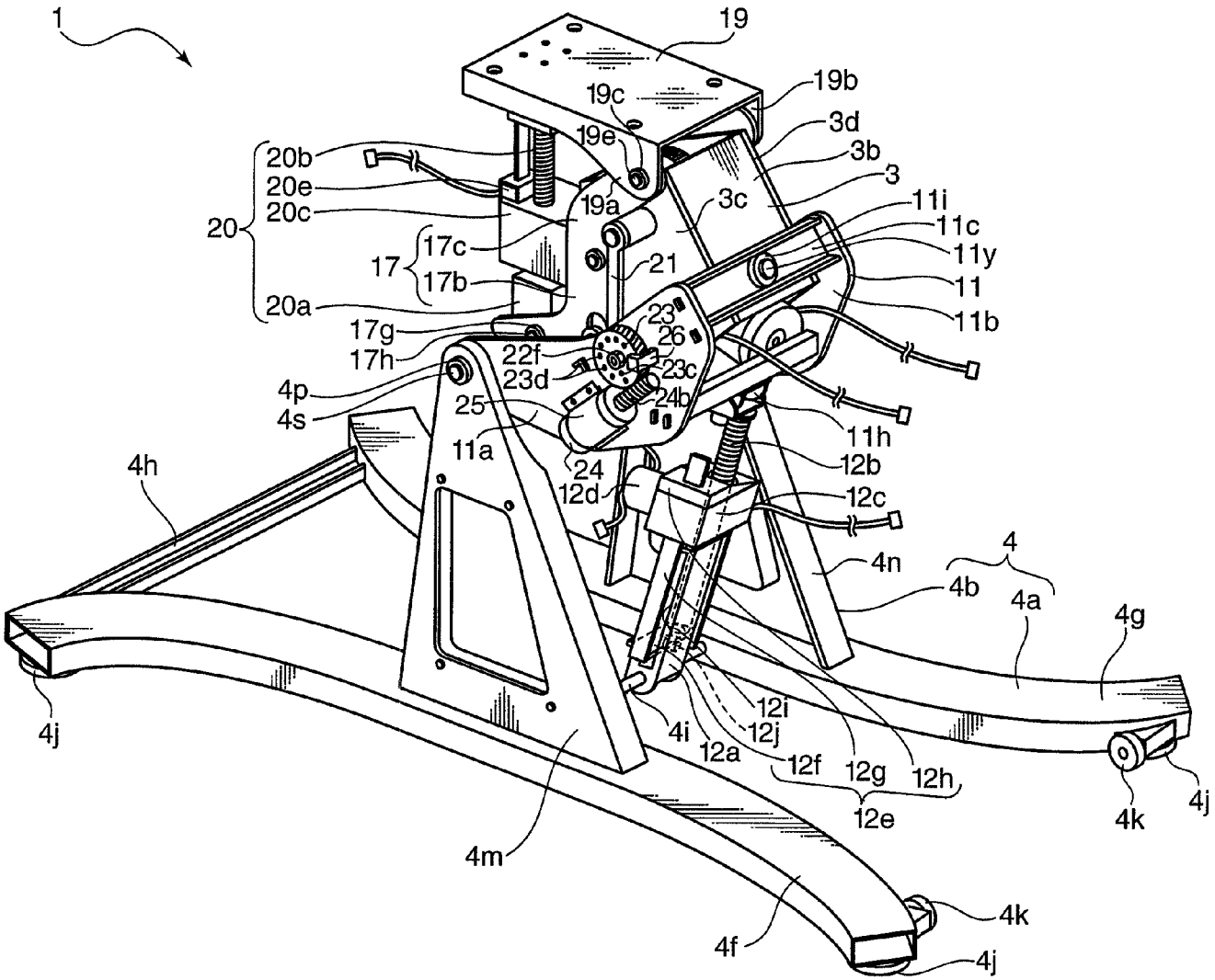
FIG. 6 is a perspective view of the balance training apparatus shown in FIG. 5, when viewed from a left rear side thereof, wherein a seat and covers are detached therefrom.
Figure 7:
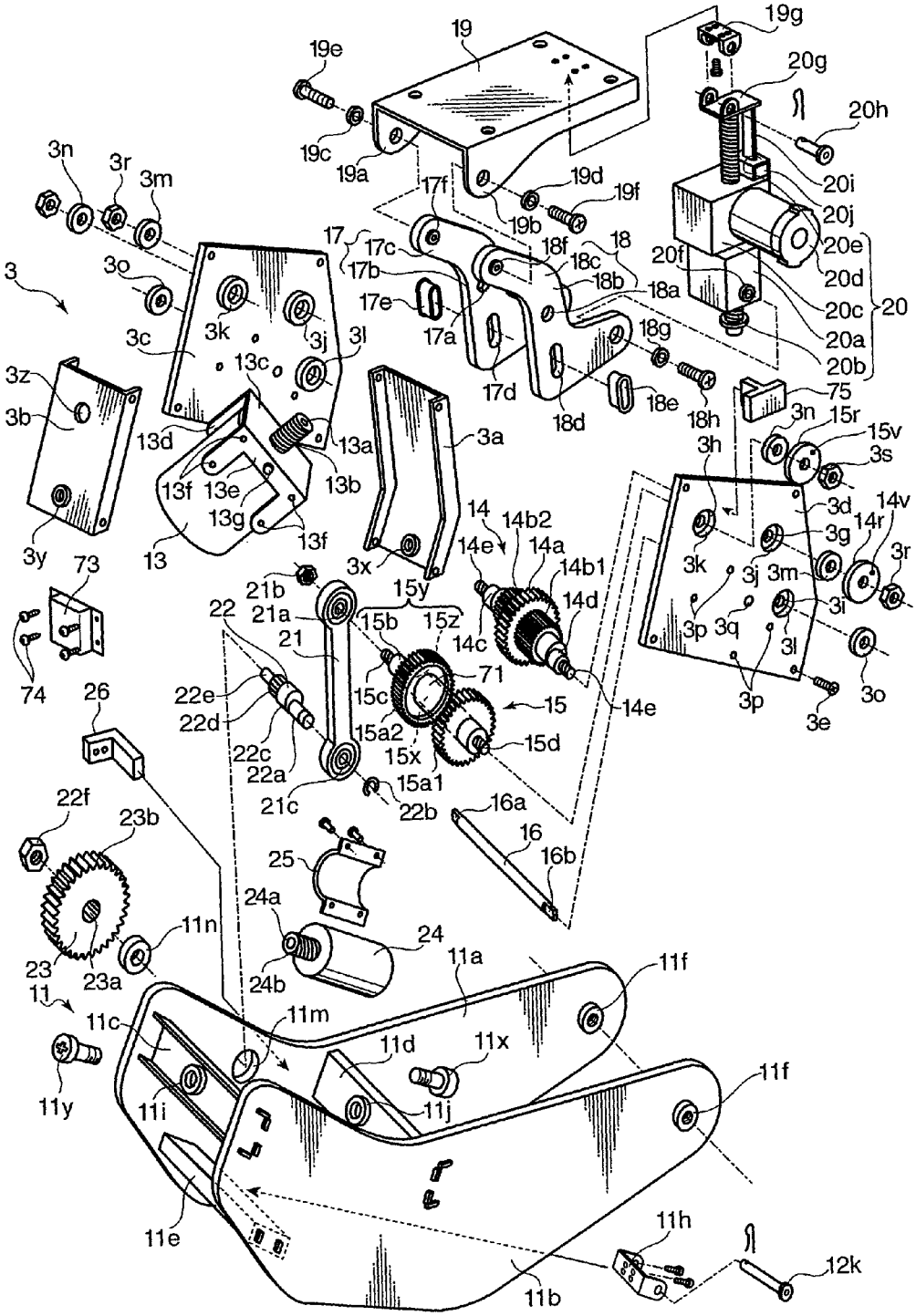
FIG. 7 is an exploded perspective view of a rocking mechanism in the balance training apparatus shown in FIG. 5.
Figure 8:
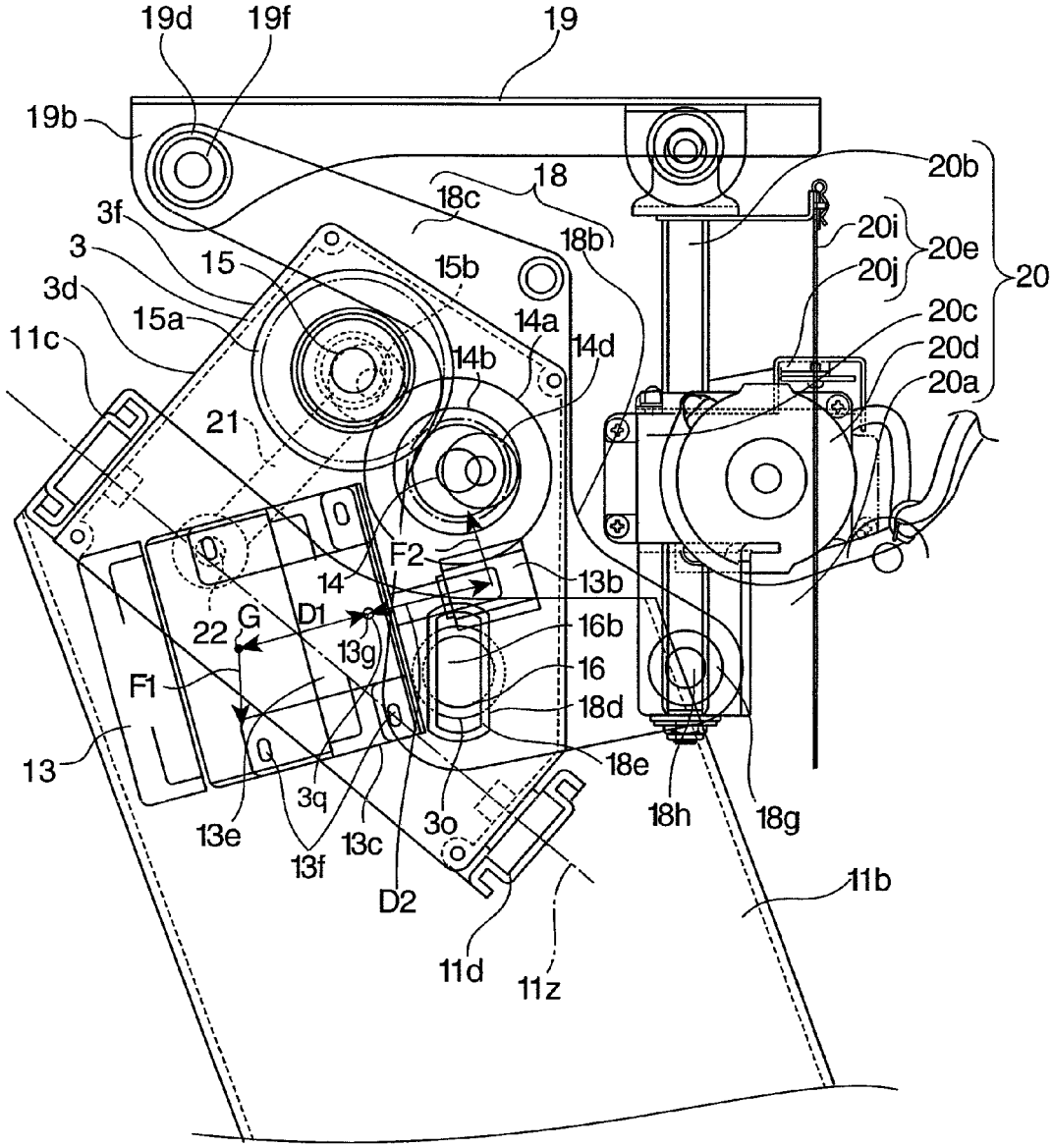
FIG. 8 is a right side view of the rocking mechanism shown in FIG. 7.

FIG. 6 is a perspective view of the balance training apparatus 1 in a state after the seat 2 and the covers 4*c*, 4*d*, 4*e* are detached therefrom. FIG. 6 shows the balance training apparatus 1 when viewed from a left rear side thereof, and FIG. 5 shows the balance training apparatus 1 when viewed from a right rear side thereof. FIGS. 7 and 8 are an exploded perspective view and a right side view of the rocking mechanism 3, respectively. With reference to FIGS. 5 to 8, the structure of the rocking mechanism 3 and associated components will be specifically described below.

The rocking mechanism 3 is supported by the leg 4 through a holding member 11. The holding member 11 comprises a pair of right and left swing plates 11*b*, 11*a* each having a central portion and front and rear portions extending slightly upwardly from the central portion to respective front and rear ends thereof at a slight angle therebetween, a rear tilt-axis support plate 11*c* connecting the respective rear ends of the swing plates 11*b*, 11*a*, a central tilt-axis support plate 11*d* connecting the respective approximately central portions of the swing plates 11*b*, 11*a*, and a lift support plate 11*e* connecting respective lower rear portions of the swing plates 11*b*, 11*a*. Each of the support plates 11*c*, 11*d*, and 11*e* is weldingly fixed to the swing plates 11*b*, 11*a*. An internally-threaded bush 11*f* is press-fittingly fixed to each of the front ends of the swing plates 11*b*, 11*a*, and threadingly engaged with a bolt 4*s* which is inserted into each of the bearings 4*p* fixed to the apex portions of the right and left pillars 4*n*, 4*m*, so that the holding member 11 is supported pivotally about a lateral axis by the bearings 4*p*. Further, a bracket 11*h* is attached to an approximately central portion of the lift support plate 11*e*, and a first telescopic lift 12 is interposed between the bracket 11*h* and the connection bar 4*i* of the leg base 4*a*. The first telescopic lift 12 is adapted to be selectively extended and retracted so as to change a tilt angle of the holding member 11 and thereby change a tilt angle of the rocking mechanism 3 in a longitudinal (i.e., X-axis or back-and-forth) direction. The tilt-axis support plates 11*c*, 11*d* are disposed in opposed relation to each other with a predetermined distance therebetween. The rear and central tilt-axis support plates 11*c*, 11*d* have rear and central bearings 11*i*, 11*j* press-fittingly fixed to laterally central portion thereof, respectively. The rocking mechanism 3 is supported by these bearings 11*i*, 11*j* in a swingingly displaceable manner as described in detail later.

The first telescopic lift 12 comprises a cylinder body 12*a*, an actuating member 12*b* adapted to be extendable/retractable relative to the cylinder body 12*a*, a gear box 12*c* attached to an upper portion of the cylinder body 12*a*, a motor 12*d* adapted to drive the gear box 12*c*, and a height detection unit 12*e*. The cylinder body 12*a* has a lower end pivotally supported relative to the leg base 4*a* by the connection bar 4*i* in a swingable manner about a lateral axis. The actuating member 12*b* is composed, for example, of a ball screw, and an upper end of the actuating member 12*b* is pivotally supported by the bracket 11*h* of the holding member 11 and a pin 12*k* in a swingable manner about a lateral axis. The ball screw is meshed with internal thread formed in an inner peripheral surface of a gear (not shown) in the gear box 12*c*, and the internally-threaded gear is adapted to be driven by a worm gear fixedly attached onto an output shaft of the motor 12*d*, so that the actuating member 12*b* can be selectively extended and retracted from/into the cylinder body 12*a* to change the tilt angle of the holding member 11 and thereby change the tilt angle of the rocking mechanism 3 in the longitudinal (i.e., X-axis or back-and-forth) direction.

As shown in FIG. 6, the height detection unit 12*e* comprises a sensor 12*h* adapted to read a displacement of a slit plate 12*g* connected to a lower end 7*d* of the actuating member 12*b* through a connection member 12*f*, so as to detect a height position of the lift support plate 11*e* and thereby detect the tilt angle of the holding member 11. The connection member 12*f* is disposed to extend across a slit 12*j* formed in the cylinder body 12*a* and enter an internal space of the cylinder body 12*a*, and connected to the lower end 7*d* of the actuating member 12*b* by a screw 12*j*.

The rocking mechanism 3 is formed in a compact structure capable of being received in a space defined by the swing plates 11*b*, 11*a* and the support plates 11*c*, 11*d*, 11*e* of the holding member 11, in a swingably displaceable manner about a longitudinal axis (X-axis), in the structure illustrated in FIG. 7. With reference to FIGS. 7 and 8, the rocking mechanism 3 will be described below. The rocking mechanism 3 comprises a motor 13, a first drive gear 14, a second drive gear 15 and a restriction shaft 16, which are housed in a housing 3*f* formed by fixing right and left side plates 3*d*, 3*c* to a front gear case 3*a* and a rear gear case 3*b*, respectively, from right and left sides of the gear cases 3*a*, 3*b* by use of screws 3*e*.

Each of the first drive gear 14, the second drive gear 15 and the restriction shaft 16 is pivotally supported in a rotatable manner about a lateral rotation axis (Y-axis) by a bearing (3*m*, 3*n*, 3*o*) fitted into a depression (3*j*, 3*k*, 3*l*) which is formed in each of the right and left side plates 3*d*, 3*c* to have a shaft hole (3*g*, 3*h*, 3*i*) in a central portion thereof.

The first drive gear 14 has a large-diameter worm wheel 14*a* which is meshed with a worm 13*b* press-fitted on an output shaft 13*a* of the motor 13. The motor 13 is provided with a bracket 13*c* fixed thereto by welding or the like. The bracket 13*c* has right and left side plates 13*e*, 13*d* each formed with a plurality of screw holes 13*f*, and each of the right and left side plates 3*d*, 3*c* is formed with a plurality of insertion holes 3*p* at positions corresponding to those of the screw holes 13*f*. The aforementioned screws 3*e* are inserted into the corresponding insertion holes 3*p*, and screwed into the corresponding screw holes 13*f* to allow the motor 13 to be fixedly assembled to the rocking mechanism 3.

The motor 13 has opposite lateral surfaces (specifically, surfaces of the right and left side plates 13*e*, 13*d* of the bracket 13*c*) each provided with a pin 13*g* protruding laterally at a position far from a gravity center G of the motor 13. In an operation of assembling the first drive gear 14, the second drive gear 15, the restriction shaft 16 and the motor 13 into the housing 3*f*, each of the pins 13*g* is firstly fitted into a pin hole 3*q* which is formed in each of the right and left side plates 3*d*, 3*c* at a position corresponding to that of the pin 13*g*. At a time just after the housing 3*f* is assembled using the screws 3*e*, the motor 13 is supported by the pins 13*a* and the pin holes 3*q* in such a manner as to be freely swingable in a space between the first drive gear 14 and the restriction shaft 16. The assembled housing 3*f* is positioned using a jig or the like to allow the restriction shaft 16 to be located below the first drive gear 14, as shown in FIG. 8. Then, when an operator releases the motor 13 held in his/her hand, the worm 13*b* is meshed with the worm wheel 14*a* according to a force F2 corresponding to a weight F1 of the motor 13 (in this rocking mechanism 3, the worm 13*b* comes into contact with the worm wheel 14*a* from below the worm wheel 14*a*). In this state, the operator installs the screws 3*e* to fix the motor 13 to the right and left side plates 3*d*, 3*c*. In this manner, an optimal backlash adjustment can be automatically achieved.

The position of the pin 13*g* or the pin hole 3*q* is determined in consideration of on the weight of the motor 13, the force F2 necessary for reducing backlash, and a posture of the housing 3*f* during the assembling operation. For example, when the motor 13 is assembled in a horizontal position, the following formula is satisfied: F1×D1=F2×D2, wherein D1 is a distance between the pin hole 3*q* and the gravity center G, and D2 is a distance between the pin hole 3*q* and a point on an axis of the output shaft 13*a* corresponding to a position where the worm 13*b* is meshed with the worm wheel 14*a*.

This makes it possible to omit a complicated operation for backlash adjustment, and eliminate the need for special components, such as a backlash adjusting screw and/or a pressurizing coil spring, so as to facilitate reduction in cost. In addition, even if, due to looseness of the screws 3*e*, vibration during transportation or an increase in load to be driven, a force is generated in a direction causing separation of the worm 13*b* from the worm wheel 14*a* meshed therewith, the weight F1 of the motor 13 can constantly apply the force F2 to the worm 13*b* in a direction for reducing backlash to suppress the occurrence of backlash noise.

The pins 13*g* and the pin holes 3*q* may be positionally exchanged with each other. Specifically, the pins 13*g* may be provided, respectively, on the side plates 3*d*, 3*c*, and the pin holes 3*q* may be formed in the motor 13. In this case, each of the pin holes 3*q* may be formed to support the pin 13*g* rotatably about an axis of the pin 13*g*. Further, in this embodiment, each of the pins 13*g* is arranged at a position closer to the output shaft 13*a* relative to the gravity center G. Alternatively, in cases where the worm 13*b* is meshed with the worm wheel 14*a* from above the worm wheel 14*a*, the pin 13*g* may be arranged on an opposite side of the output shaft 13*a* with respect to the gravity center G to obtain the same advantage of being able to eliminate the need for backlash adjustment.

A torque of the motor 13 is transmitted from the worm 13*b* to the first drive gear 14, and then transmitted from right and left first eccentric shafts 14*d*, 14*c* formed at right and left ends of the first drive gear 14 to right and left shaft holes 18*a*, 17*a* formed, respectively, around central portions of right and left up-and-down levers 18, 17 disposed outside the housing 3*f*. As shown in FIG. 8, each of the up-and-down levers 18, 17 has a base end portion (18*b*, 17*b*) having an approximately L shape, and a free end portion (18*c*, 17*c*) extending from the base end portion (18*b*, 17*b*) obliquely upwardly and rearwardly. The base end portions 18*b*, 17*b* are supported by the first eccentric shafts 14*d*, 14*c*, respectively.

The restriction shaft 16 located below the first drive gear 14 is designed to prevent the base end portions 18*b*, 17*b* of the up-and-down levers 18, 17 from being rotated (turned over) about the first eccentric shafts 14*d*, 14*c*, as described in detail later. Thus, according to the first drive gear 14, the up-and-down levers 18, 17 perform an elliptic motion in side view. Each of the ends of the first drive gear 14 penetrating through the corresponding bearings 3*m* and the corresponding shaft holes 18*a*, 17*a* of the up-and-down levers 18, 17 has an externally threaded portion 14*e*, and a nut 3*r* is threadingly fastened to the externally-threaded portion 14*e* to prevent the first drive gear 14 from falling off.

The restriction shaft 16 is formed to have an outer diameter corresponding to an inner diameter of each of the bearings 3*o*. Thus, the restriction shaft 16 is angularly displaceable within the bearing 3*o*, i.e., about the lateral axis (Y-axis). The restriction shaft 16 has right and left ends formed as right and left connection protrusions 16*b*, 16*a* extending along one diametral line in cross section. The right and left connection protrusions 16*b*, 16*a* are fittingly inserted, respectively, into right and left slide bearings 18*e*, 17*e* fitted into right and left elongate holes 18*d*, 17*d* each formed in the approximately L-shaped base end portion (18*b*, 17*b*) of the up-and-down lever (18, 17) at a position below the shaft hole (18*a*, 17*a*) to extend vertically, and provided with means for preventing the restriction shaft 16 from falling off. Thus, the restriction shaft 16 restricts a horizontal movement of lower regions of the up-and-down levers 18, 17 which is otherwise caused by the first eccentric shafts 14*d*, 14*c*, while permitting an up and down movement of the lower regions of the up-and-down levers 18, 17. This makes it possible to allow a horizontal stroke (stroke: rocking range or amplitude) to become greater than a vertical stroke so as to provide an elliptic motion in side view to the seat 2.

In this embodiment, the restriction shaft 16 is employed as restriction means. Alternatively, any other suitable restriction means capable of reciprocating the up-and-down levers 18, 17, such as a reciprocating linkage, may be used. Further, depending on rocking loci required for the seat 2, the shape and/or longitudinal direction of the elongate hole (18*d*, 17*d*) may be appropriately changed. Specifically, the shape of the elongate hole (18*d*, 17*d*) is not limited to a linear shape, but may be an arc shape, or an arc shape formed by combining a plurality of different radii (curvatures). Further, the elongate hole (18*d*, 17*d*) may be formed to extend horizontally or obliquely.

Figure 25:
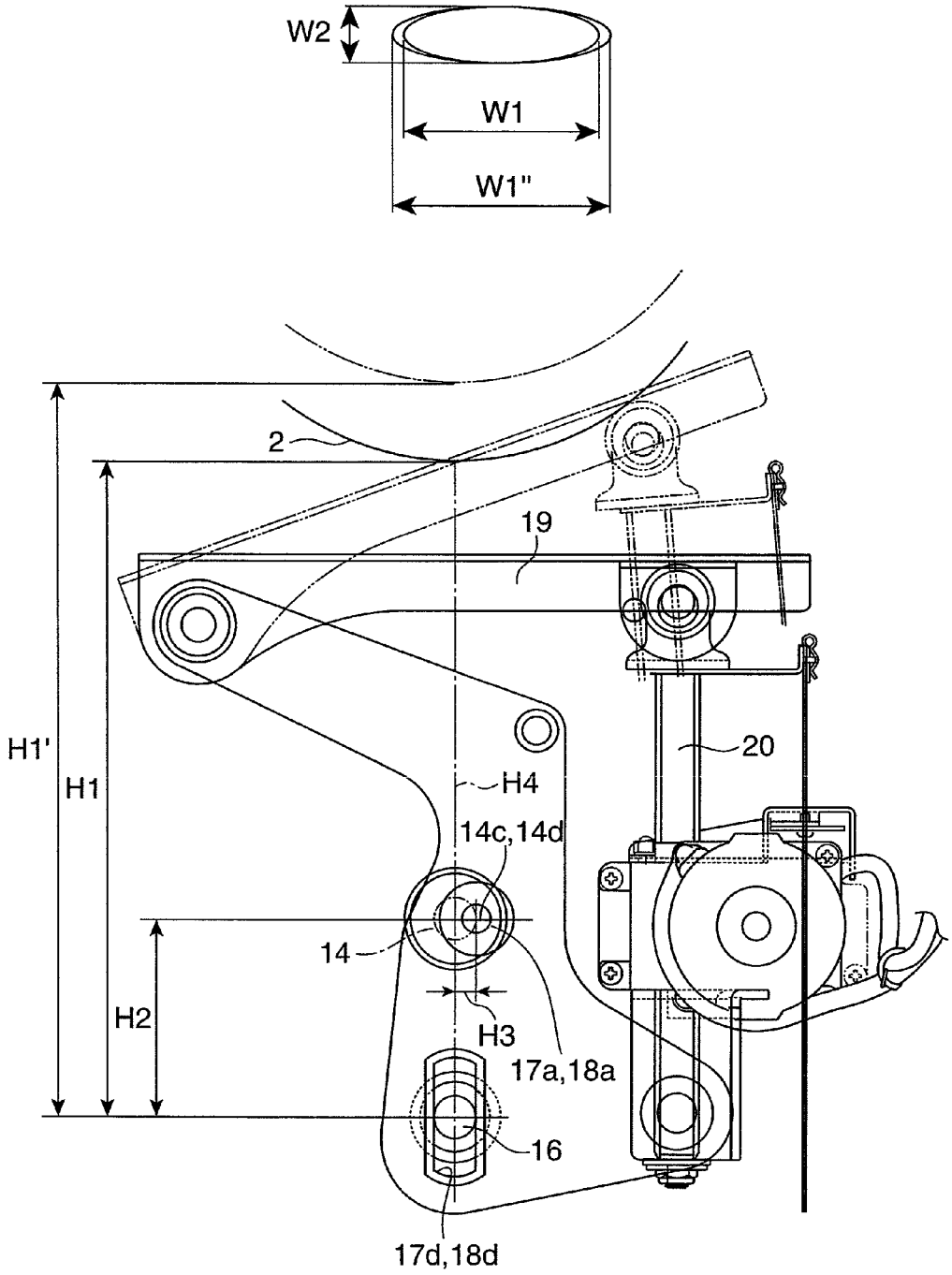
FIG. 25 is a side view showing a seat rocking locus under a condition that only a second telescopic lift for tilting the seat is extended.

As shown in FIG. 25, given that a distance between the restriction shaft 16 and the seat 2, and a distance between the restriction shaft 16 and the first drive gear 17, are H1 and H2, respectively, and an eccentric amount (stroke) of the first eccentric shaft (14*c*, 14*d*) is H3, the eccentric amount is magnified H1/H2 times, as described in detail later. Further, when an alignment line H4 of respective centers of the restriction shaft 16 and the first eccentric shaft (14*c*, 14*d*) is tilted, a ratio between the horizontal stroke and the vertical stroke is changed so as to increase or reduce the strokes, as described in detail later.

Each of the free end portions 18*c*, 17*c* of the up-and-down levers 18, 17 has an internally-threaded bush (18*f*, 17*f*) press-fittingly fixed thereto. The seat 2 is mounted on a mount member 19 which is formed with right and left brackets 19*b*, 19*a* extending downwardly from a rear end thereof and having a bearing (19*d*, 19*c*) press-fittingly fixed thereto. Two bolts 19*f*, 19*e* are inserted into the bearings 19*d*, 19*c* and threadingly fastened to the internally-threaded bushes 18*f*, 17*f*, respectively. In this manner, the rear end of the mount member 19 is pivotally supported about a lateral axis (Y-axis) by the up-and-down levers 18, 17. The mount member 19 has a front bracket 19*g* which is fixed to a front end thereof, and connected to respective front ends of the up-and-down levers 18, 17 through a second telescopic lift 20.

The second telescopic lift 20 has a similar structure to that of the first telescopic lift 12. Specifically, the second telescopic lift 20 comprises a cylinder body 20*a*, an actuating member 20*b* adapted to be extendable/retractable relative to the cylinder body 20*a*, a gear box 20*c* attached to an upper portion of the cylinder body 20*a*, a motor 20*d* adapted to drive the gear box 20*c*, and a height detection unit 20*e*. The cylinder body 20*a* has right and left internally-threaded bushes 20*f* which are press-fittingly fixed, respectively, to right and left sides of a lower end thereof. Correspondingly, right and left bearings 18*g*, 17*g* are press-fittingly fixed to the front ends of the up-and-down levers 18, 17, respectively. Two bolts 18*h*, 17*h* are inserted into the right and left bearings 18*g*, 17*g* and threadingly fastened to the right and left bushes 20*f*, respectively. In this manner, the lower end of the second telescopic lift 20 is pivotally supported about a lateral axis (Y-axis) by the up-and-down levers 18, 17.

The actuating member 20*b* is composed, for example, of a ball screw, and a bracket 20*g* is fixedly attached to an upper end of the actuating member 20*b*. The bracket 20*g* is pivotally supported relative to the bracket 19*g* of the mount member 19 by a pin 20*h* in a swingable manner about a lateral axis. The ball screw is meshed with internal thread formed in an inner peripheral surface of a gear (not shown) in the gear box 20*c*, and the internally-threaded gear is adapted to be driven by a worm gear fixedly attached onto an output shaft of the motor 20*d*, so that the actuating member 20*b* can be selectively extended and retracted from/into the cylinder body 20*a* to change a tilt angle of the mount member 19 and thereby change a tilt angle of the seat 2 in the longitudinal (i.e., X-axis or back-and-forth) direction. The height detection unit 20*e* comprises a sensor 20*j* adapted to read a displacement of a slit plate 20*i* connected to the bracket 20*g* so as to detect a height position of the front end of the mount member 19 and thereby detect the tilt angle of the mount member 19.

Figure 32:
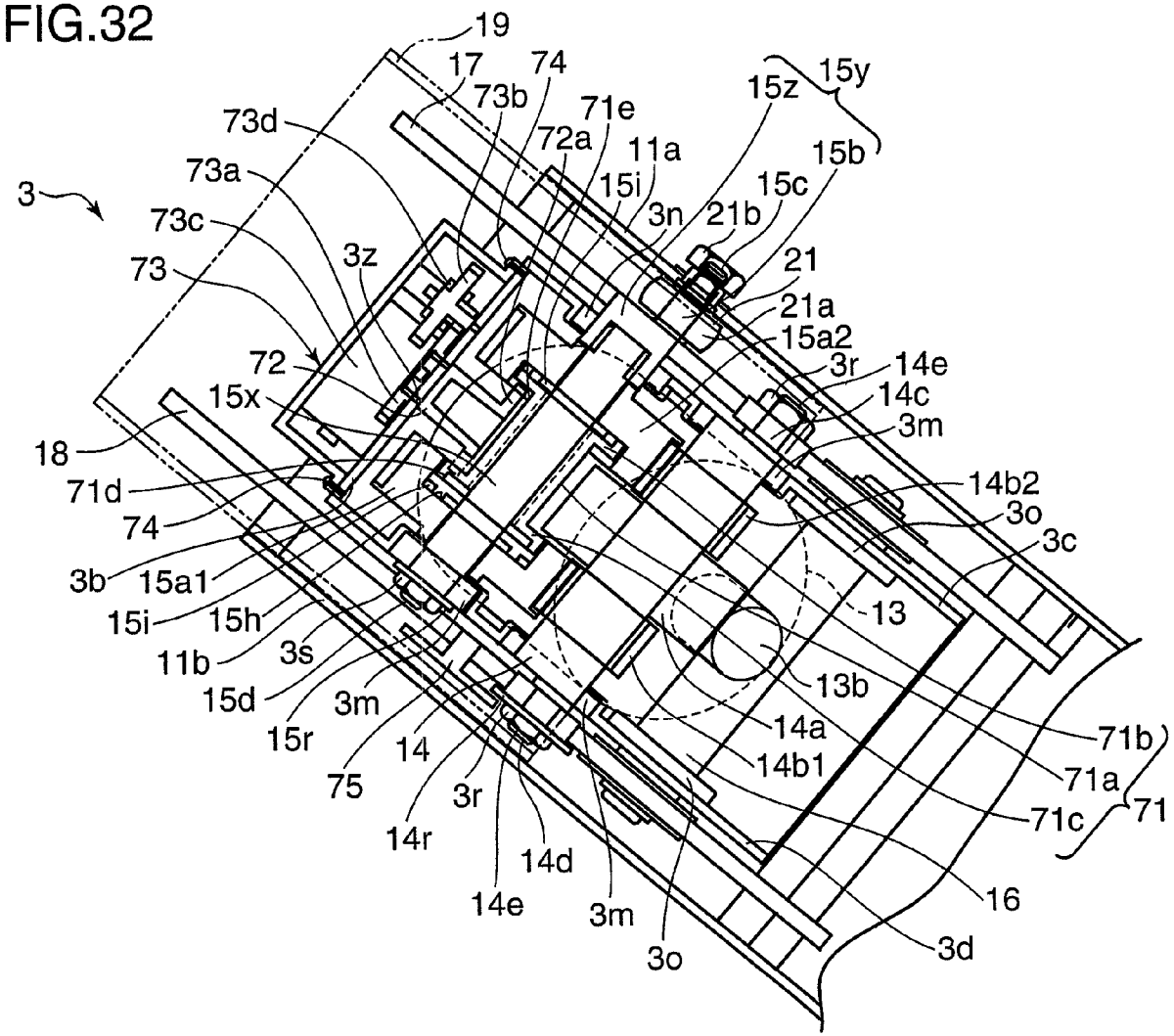
FIG. 32 is an explanatory diagram of a gear-ratio switching mechanism for the second drive gear.

In the rocking mechanism 3, the torque of the motor 13 transmitted from the worm 13*b* to the first drive gear 14 is also transmitted from either one of right and left small-diameter gears 14*b*1, 14*b*2, to a corresponding one of right and left gears 15*a*1, 15*a*2 of the second drive gear 15. FIG. 32 specifically shows the structure of the second drive gear and associated components. The second drive gear 15 has a shaft portion 15*x* located in an approximately central region thereof and formed as a splined shaft, and a switching member 71 fitted on the shaft portion 15*x*. The shaft portion 15*x* of the second drive gear 15 has right and left ends formed as bearings capable of rotatably supporting the right and left gears 15*a*1, 15*a*2 without any displacement in an axial direction thereof.

The second drive gear 15 has a left end with a cap-shaped eccentric block 15*y* fittingly fixed thereto. The eccentric block 15*y* has a base end 15*z* rotatably supported by the bearing 3*n* fixed to the left side plate 3*c*, and a second eccentric shaft 15*b* protruding laterally from the base end 15*z*. The second eccentric shaft 15*b* is fitted into a swivel 21*a* which is provided at one end (i.e., upper end) of an eccentric rod 21. The second eccentric shaft 15*b* has an externally -thread distal end 15*c*, and a nut 21*b* is threadingly fastened to the distal end 15*c* to prevent the left end of the second drive gear 15 from falling off. The second drive gear 15 has a right end inserted into the bearing 3*n* fixed to the right side plate 3*d*, and a nut 3*s* is threadingly engaged with an externally-threaded distal portion 15*d* of the right end to prevent the right end of the second drive gear 15 from falling off.

The swivel 21*a* has a spherical-shaped bearing surface, and the same type of swivel 21*b* is provided in the other end (i.e., lower end) of the eccentric rod 21. The eccentric rod 21 is associated with a shaft 22 which has a third eccentric shaft 22*a* formed on the side of a right end thereof and inserted into the eccentric rod 21, and an E-ring 22*b* is attached to the right end to prevent the shaft 22 from falling off. The left swing plate 11*a* of the holding member 11 has a bearing 11*n* press-fitted into a hole 11*m* formed in the rear end thereof, and a central portion 22*c* of the shaft 22 is rotatably supported by the bearing 11*n*. The shaft 22 is formed with a gear 22*d* on a left side of the central portion 22*c*.

The gear 22*d* is meshed with internal teeth 23*a* formed in an inner peripheral surface of a gear 23 disposed outside the left swing plate 11*a*, and a retaining nut 22*f* is threadingly fastened to an externally-threaded left end 22*e* of the shaft 22. Thus, the shaft 22 is integrated with the gear 23 in such a manner as to be rotated together. The gear 23 has an outer peripheral surface formed with external teeth 23*d* which are meshed with a worm 24*b* press-fitted on an output shaft 24*a* of a motor 24. The motor 24 is received in a depression formed in an outer surface of the left swing plate 11*a*, and mounted to the left swing plate 11*a* by a mounting member 25. A rotational angle of the gear 23 integrated with the shaft 22 is detected by an encoder 26. As shown in FIG. 6, the encoder 26 is adapted to detect a reference pit 23*c* formed in an end surface of the gear 23, and count a number of pits 23*a* formed in the end surface at even intervals, according to rotation of the gear 23, so as to detect the rotational angle of the gear 23 and thereby detect a position of an after-mentioned swing support point of the eccentric rod 21.

In the rocking mechanism 3, respective lower portions of the front and rear gear cases 3*a* are formed in parallel to each other, and front and rear internally-threaded bushes 3*x*, 3*y* are press-fittingly fixed to the lower portions, respectively. Two bolts 11*x*, 11*y* are inserted into the central and rear bearings 11*j*, 11*i* fixed to the central and rear tilt-axis support plates 11*d*, 11*c*, and threadingly fastened to the bushes 3*x*, 3*y*, respectively. In this manner, the rocking mechanism 3 is supported by the swing plates 11*b*, 11*a* in a swingable (i.e., rotatable) manner about a swing axis defined by a line 11*z* connecting the bearings 11*j*, 11*i*. Thus, when the second drive gear 15 is rotated, the rocking mechanism 3 is swingingly moved about the swing axis 11*z* by an action of the first eccentric shaft 15*b* and the eccentric rod 21. During this movement, even though the eccentric rod 21 is displaced to repeatedly come closer to and get away from the left side plate 3*c* or repeated displaced back and forth, the swivels 21*a*, 21*c* can prevent the eccentric rod 21 from being disengaged from the second drive gear 15 and the shaft 22 so as to keep transmitting a driving force therethrough.

When the motor 24 is activated to rotationally drive the gear 23, the third eccentric shaft 22*a* connected to the lower end of the eccentric rod 21, i.e., a swing support point of the eccentric rod 21, can be displaced up and down. This makes it possible to offset a position of the rocking mechanism 3 about the swing axis 11*z*, relative to the holding member 11, so as to swingingly move the rocking mechanism 3 about the swing axis 11*z*, or rockingly move the seat 2, based on a position where the rocking mechanism 3 is tilted about the swing axis 11*z* by a predetermined angle, as described in detail later. In addition, the third eccentric shaft 22*a* is driven by the worm 24*b* and the gear 23. This structure can present the tilt angle from being changed due to load.

Figure 33:
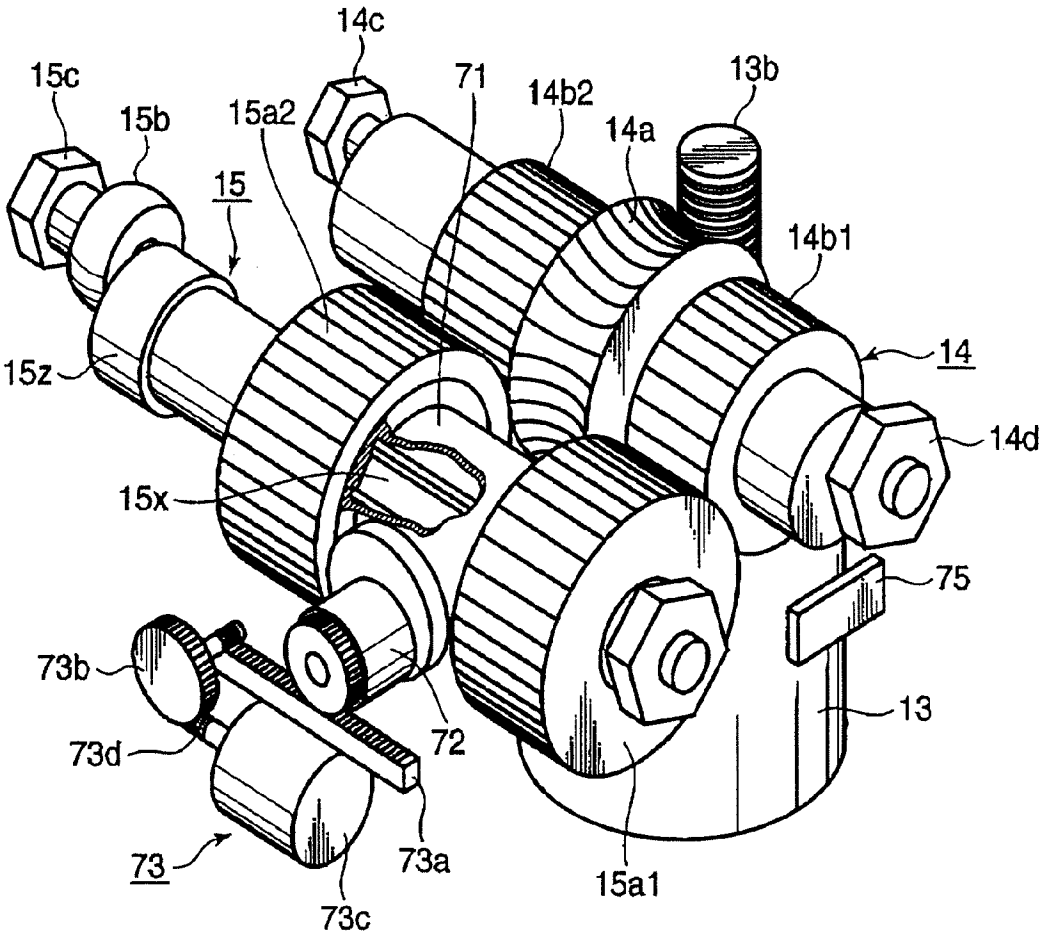
FIG. 33 is a perspective view of the gear-ratio switching mechanism for the second drive gear, shown in FIG. 32.

Referring to FIGS. 32, 33, and 7 again, the switching member 71 comprises a cylinder 71*a* movable along the splined shaft portion 15*x* in an axial direction thereof, and right and left flanges 71*c*, 71*b* formed at right and left ends of the cylinder 71*a*, respectively. Each of the flanges 71*c*, 71*b* has an end surface formed as a tooth flank 71*d*. Each of the gears 15*a*1, 15*a*2 of the second drive gear 15 is formed in an angular C shape in axial section. A concave portion 15*h* of the angular C-shaped gear has a bottom which is formed with a tooth flank 15*i* corresponding to the tooth flank 71*d*, on an outward side thereof, and provided with a magnet 15*j* on an inward side thereof. Each of the gears 15*a*1, 15*a*2 is made of a nonmagnetic material, and the switching member 71 is made of a magnetic material.

An eccentric cam 72 is provided in a concave portion 71*e* of the switching member 71 formed in an I-shape in axial section. This eccentric cam 72 is designed to be rotatable about a hole 3*z* formed in an upper end of the rear gear case 3*b*, i.e., about an axis orthogonal to the axis of the second drive gear 15. Specifically, when the eccentric cam 72 is rotated, one of surfaces of the flanges 71*c*, 71*b* on the side of the concave portion 71*e* is pushed by an elongated portion 72*a* of the eccentric cam 72, so that the switching member 71 is slidingly moved in the axial direction of the second drive gear 15 to allow the tooth flank 71*d* to be meshed with the tooth flank 15*i* in one of the gears 15*a*1, 15*a*2.

Thus, the torque from the first drive gear 14 to the second drive gear 15 is transmitted through either one of a first line from the gear 14*b*1 to the gear 15*a*1 and a second line from the gear 14*b*2 to the gear 15*a*2, i.e., at either one of two different rotation-number ratios, as mentioned above. Then, in view of subsequent vibration and other negative factors, the switching member 71 is magnetically attached to the magnet 15*j*. Thus, even if the eccentric cam 72 is slightly rotated, the driving force can be stably transmitted.

When the elongated portion 72*a* of the eccentric cam 72 is in a neutral position where the elongated portion 72*a* is being moved from one of the flanges 71*c*, 71*b* to the other flange, only the current engagement between the tooth flanks 71*d*, 15*i* is released without transmitting any driving force to the second drive gear 15, and only the first drive gear 14 is rotated according to the rotation of the motor 13. Thus, a phase relationship between the first drive gear 14 and the second drive gear 15 can be freely changed.

The eccentric cam 72 is designed to be rotationally driven by a drive mechanism 73 fixed to the upper end of the rear gear case 3*b* by screws 74. The drive mechanism 73 comprises a switching gear 73*a* disposed to penetrate the hole 3*z* and adapted to rotationally drive the eccentric cam 72, a motor 73*c*, and a worm 73*d* attached onto an output shaft of the motor 73*c* and adapted to rotationally drive the switching gear 73*a*.

As above, in the above embodiment, the second drive gear 15 and the eccentric rod 21 constitute a part of a plurality of converters, i.e., first converter. The first drive gear 14, the restriction shaft 14 and the up-and-down levers 17, 18 constitute the rest of the plurality of converter, i.e., second converter. The gears 15*a*1, 15*a*2, the switching member 71, the eccentric cam 72 and the drive mechanism 73 constitute a clutch device. Further, the gears 15*a*1, 15*a*2 and the gears 14*b*1, 14*b*2 constitute a gear changer.

Figure 9:
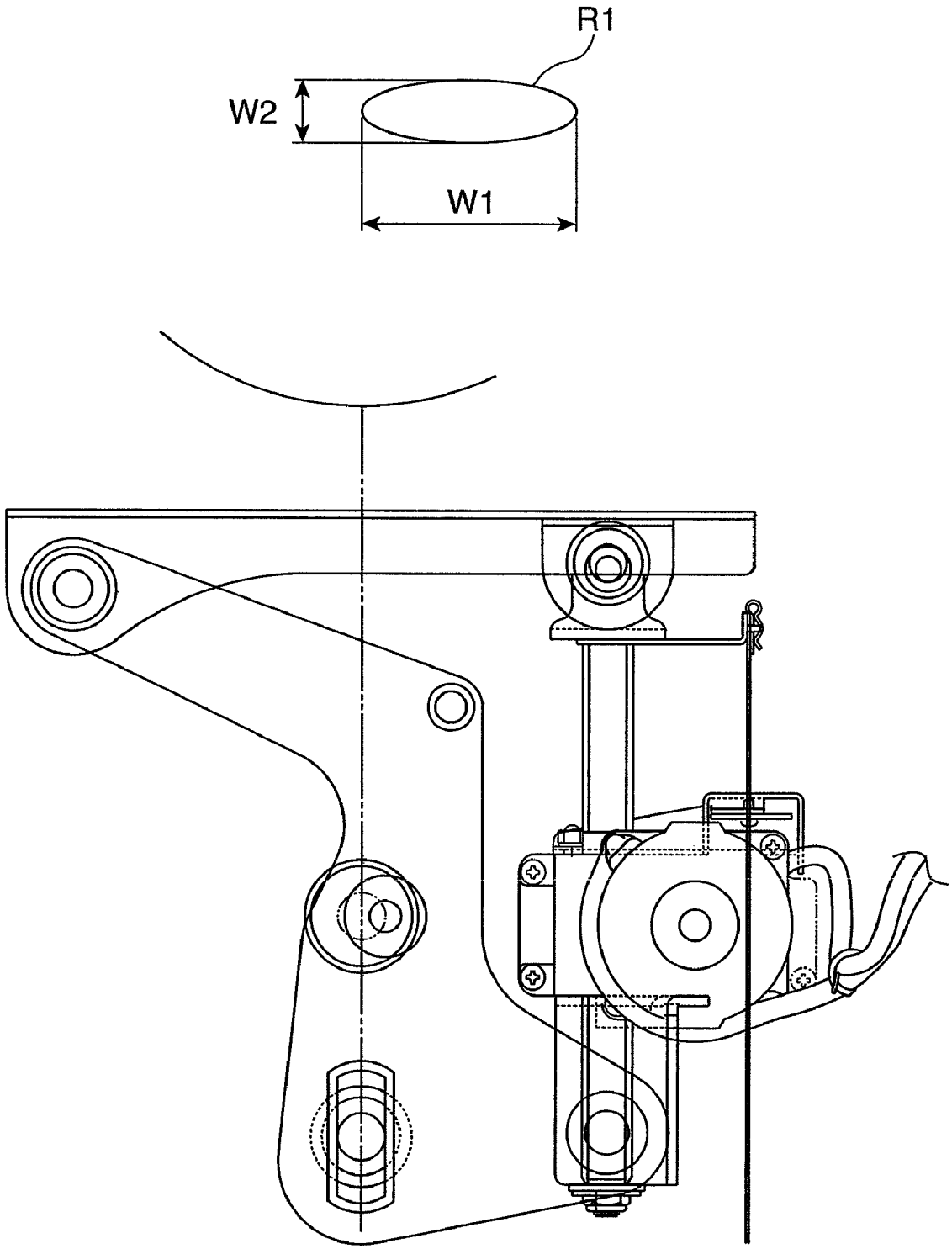
FIG. 9 is a side view showing a seat rocking locus including an up-and-down motion in a balance training apparatus according to the embodiment of the present invention.

In the balance training apparatus according to the above embodiment, when the motor 13 is rotated, the seat 2 is reciprocated in the back-and-forth (X-axis or longitudinal) direction and an up-and-down (Z-axis or vertical) direction so as to be rockingly moved along an elliptic locus R1 in side view as shown in FIG. 9, according to the first eccentric shafts 14*d*, 14*c* of the first drive gear 14, the up-and-down levers 18, 17 and the restriction shaft 16. Thus, based on a compact structure designed such that the up-and-down levers 18, 17 supporting the mount member 19 loaded with the seat 2 (i.e., mounting the seat 2 thereon) are driven by the single first drive mechanism 14, a rocking motion (reciprocating motion) in the up-and-down (Z-axis) direction can be added to a rocking motion (reciprocating motion) in the back-and-forth (X-axis) direction so as to move the sheet 2 along the elliptic locus R1. This makes it possible to increase a number of rocking patterns. In addition, the combination of the conventional back-and-forth (X-axial) rocking motion (reciprocating motion) and the newly added up-and-down (Z-axial) rocking motion (reciprocating motion) can stimulate autonomic nerves of a subject and improve leg strength. Furthermore, a rocking motion along a circular or elliptic locus in side view allows a load on a human body to be changed smoothly and continuously so as to provide enhanced effects of exercise while minimizing damages to the human body.

Figure 10:
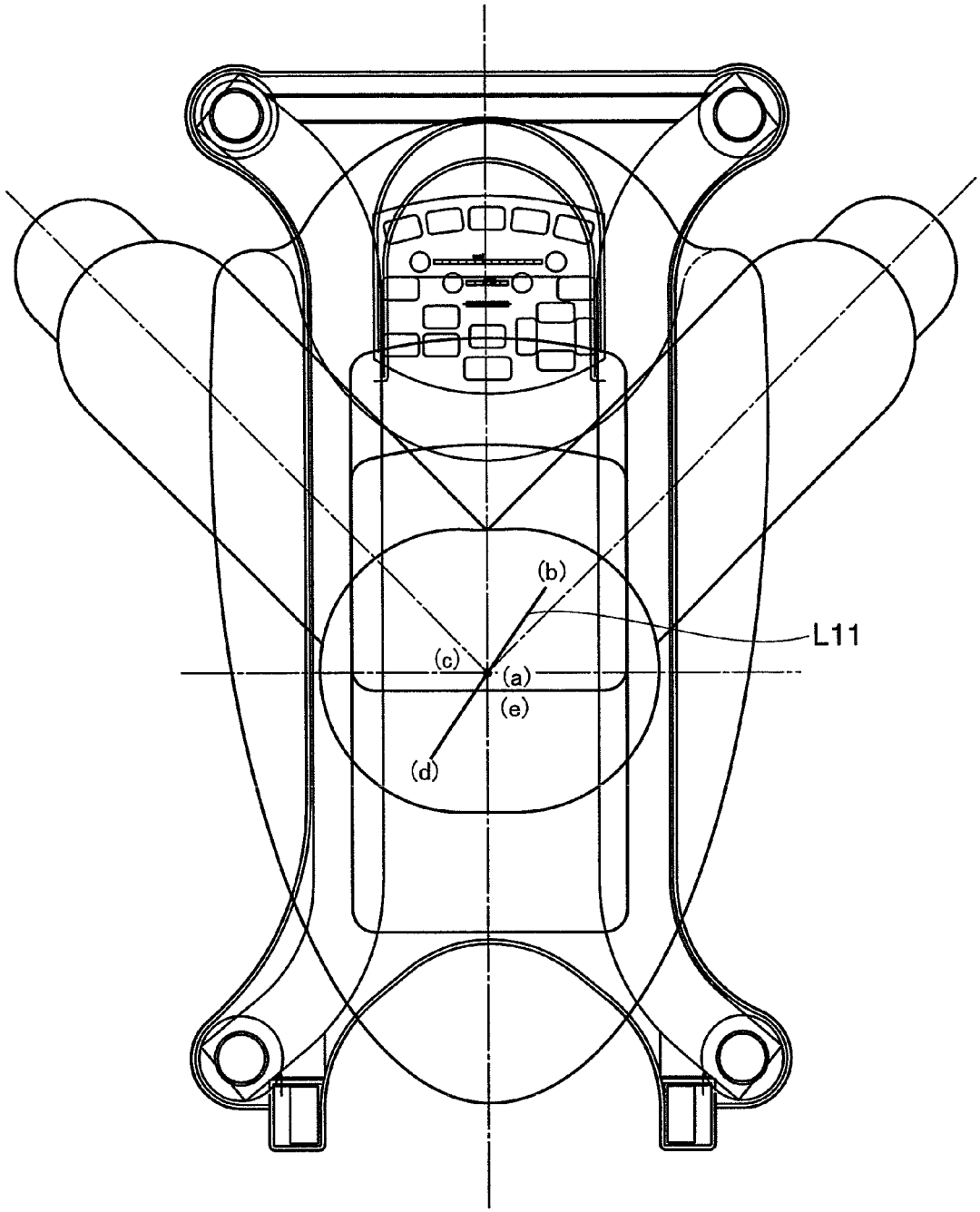
FIG. 10 is a top plan view showing a seat rocking locus under a condition that a gear-ratio between first and second drive gears is 1:1, and phase timings of their origins are coincident with each other at zero degree.
Figure 11:
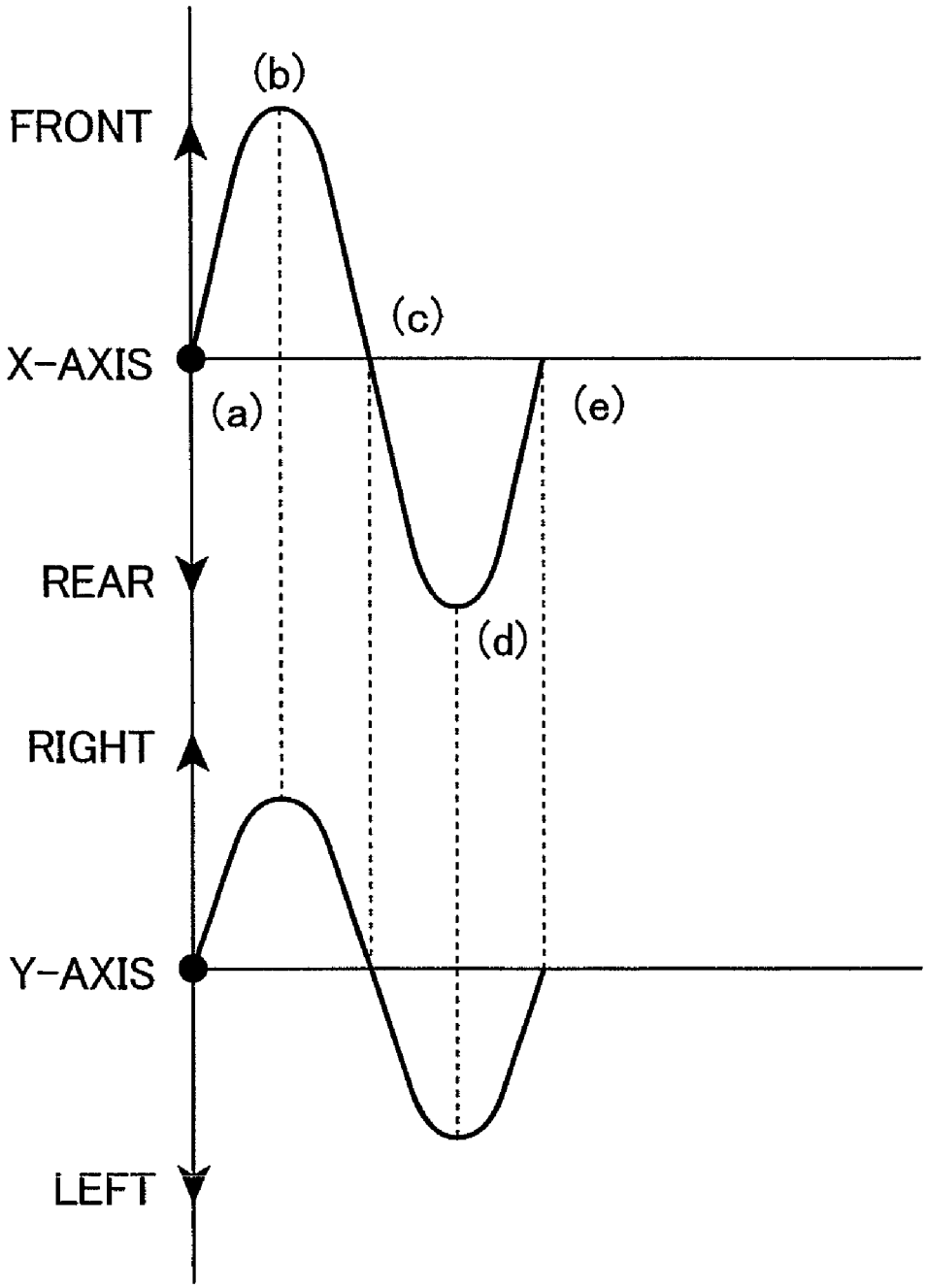
FIG. 11 is a graph showing changes in mesh engagement between the first and second drive gears under the condition shown in FIG. 10.

For example, in the above balance training apparatus, when a cycle ratio, i.e., gear-ratio, of the gear 14*b*1 or 14*b*2 of the first drive gear 14 to the gear 15*a*1 or 15*a*2 of the second drive gear 14 is set at 1:1, a rotation-number ratio is 1:1. In this case, if phase timings of respective origins of the two gears are coincident with each other at zero degree, the seat 2 will be rockingly moved along a linear locus L11 extending diagonally rearwardly and leftwardly in top plan view, as shown in FIG. 10. FIG. 11 shows a change in mesh engagement between the first drive gear 14 (X-axis direction) and the second drive gear 15 (Y-axis direction), i.e., changes in position of seat 2 in the X-axis and Y-axis directions, under this condition. If the phase of the second drive gear 15 is delayed by 180 degrees relative to the phase of the first drive gear 14, a linear locus different only in rocking direction (i.e., a linear locus extending diagonally rearwardly and rightwardly in top plan view) will be obtained.

Figure 12:
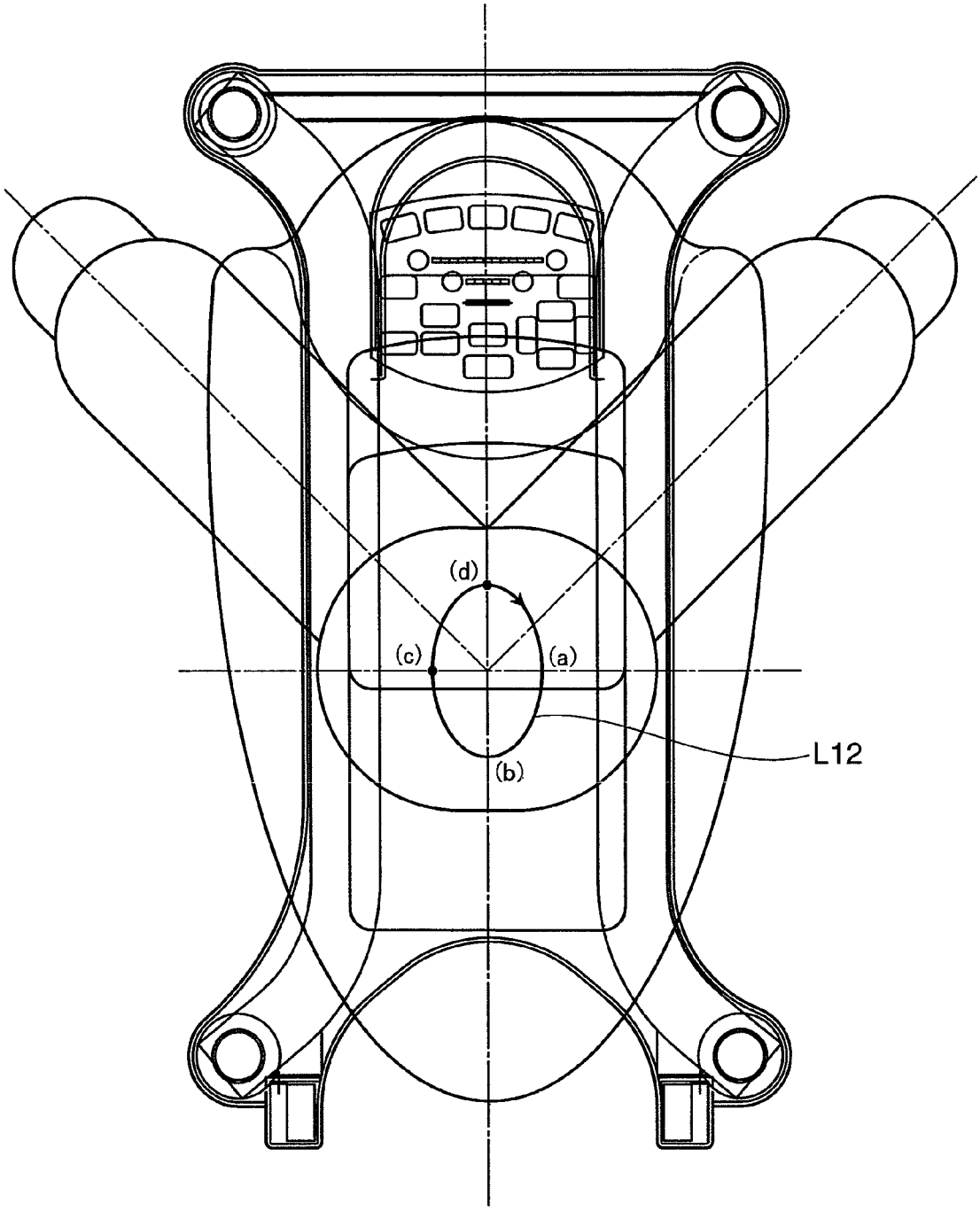
FIG. 12 is a top plan view showing a seat rocking locus under a condition that the gear-ratio between the first and second drive gears is 1:1, and the phase timings of their origins are shifted by 90 degrees with respect to each other.
Figure 13:
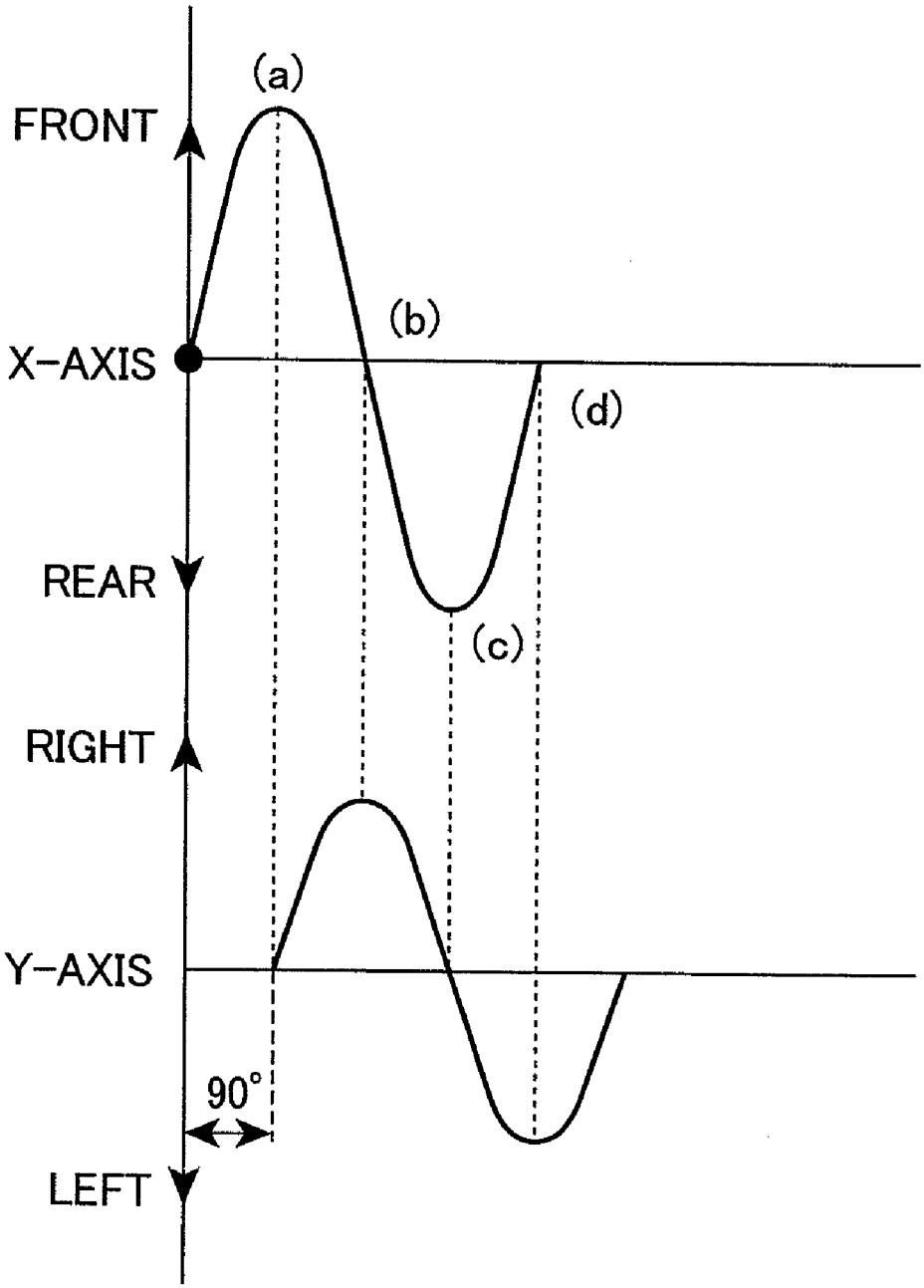
FIG. 13 is a graph showing changes in mesh engagement between the first and second drive gears under the condition shown in FIG. 12.

In the above case, if the phase timing of the mesh engagement between the first drive gear 14 (X-axis direction) and the second drive gear 15 (Y-axis direction) is shifted by ¼ cycle, i.e., 90 degrees, with respect to each other, the seat 2 will be rockingly moved along a circular locus L12 in top plan view according to a swing movement of the eccentric rod 21, as shown in FIG. 12. FIG. 13 shows a change in mesh engagement between the first drive gear 14 and the second drive gear, under this condition. FIGS. 12 and 13 show one example in which the phase of the second drive gear 15 is delayed by 90 degrees relative to the phase of the first drive gear 14. If the phase of the second drive gear 15 is advanced by 90 degrees, i.e., delayed by 270 degrees, a circular locus different only in starting point will be obtained. In case of other phase shift angle, a locus formed by modifying the above locus based on a ratio between the respective phase shift angles will be obtained.

Figure 14:
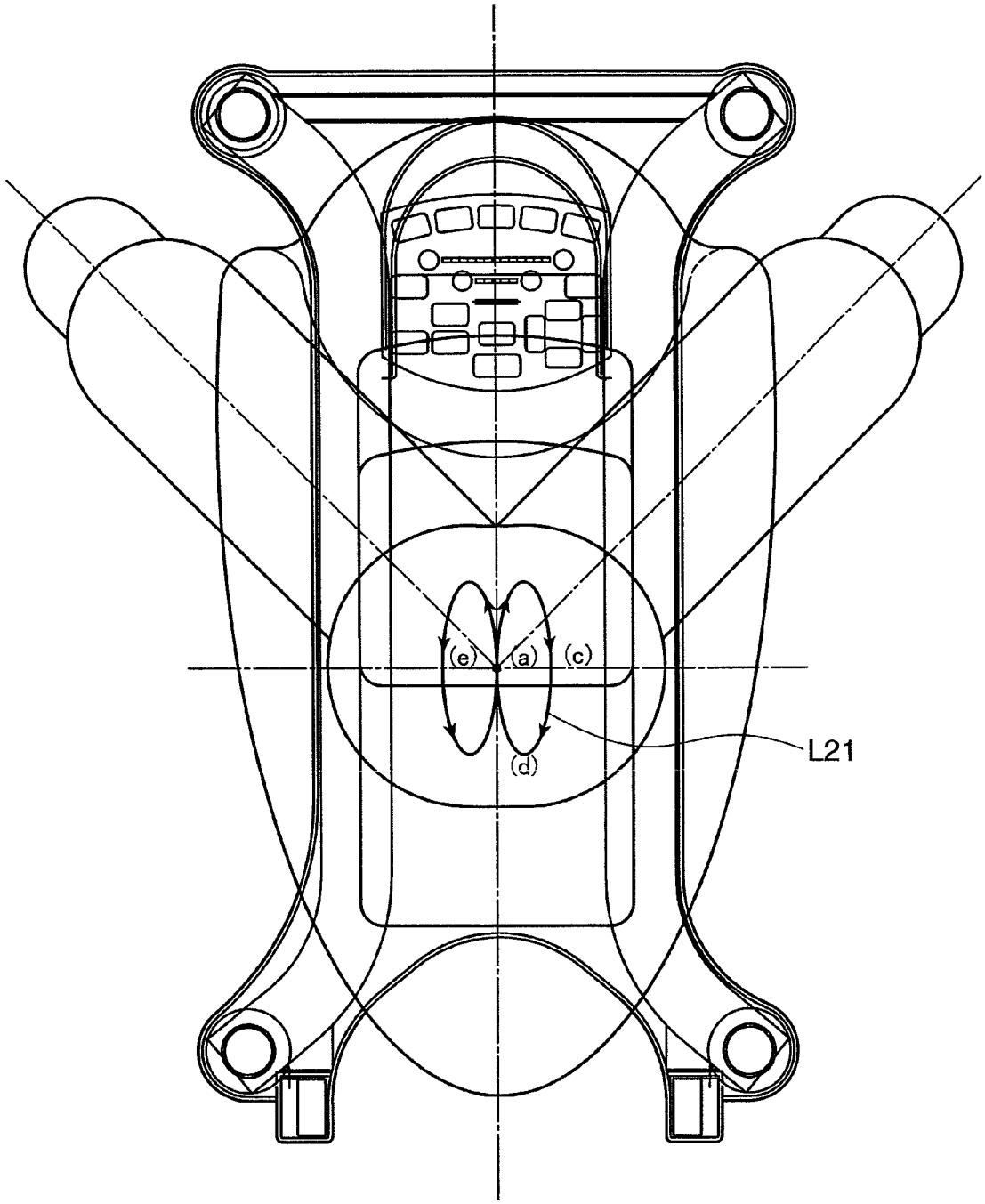
FIG. 14 is a top plan view showing a seat rocking locus under a condition that the gear-ratio between the first and second drive gears is 1:2, and the phase timings of their origins are coincident with each other at zero degree.
Figure 15:
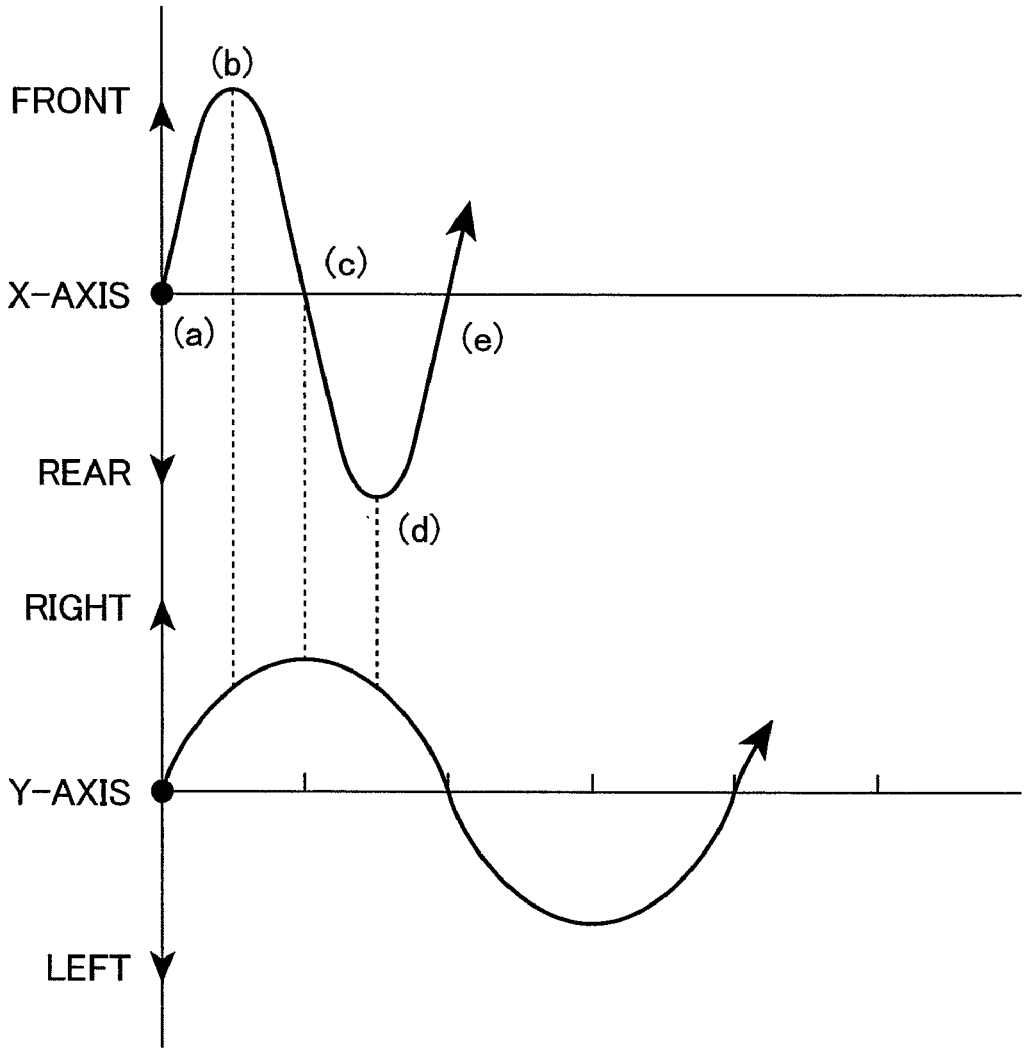
FIG. 15 is a graph showing changes in mesh engagement between the first and second drive gears under the condition shown in FIG. 14.

When the gear-ratio of the gear 14*b*1 or 14*b*2 of the first drive gear 14 to the gear 15*a*1 or 15*a*2 of the second drive gear 14 is set at 1:2, the rotation-number ratio is 2:1. In this case, if the phase timings of the respective origins of the two gears are coincident with each other at zero degree, the seat 2 will be rockingly moved along a horizontal figure-of-eight shaped locus L21 (extending laterally outwardly from the inner side) in top plan view according to a swing movement of the eccentric rod 21, as shown in FIG. 14. FIG. 15 shows a change in mesh engagement between the first drive gear 14 and the second drive gear 15 under this condition.

Figure 16:
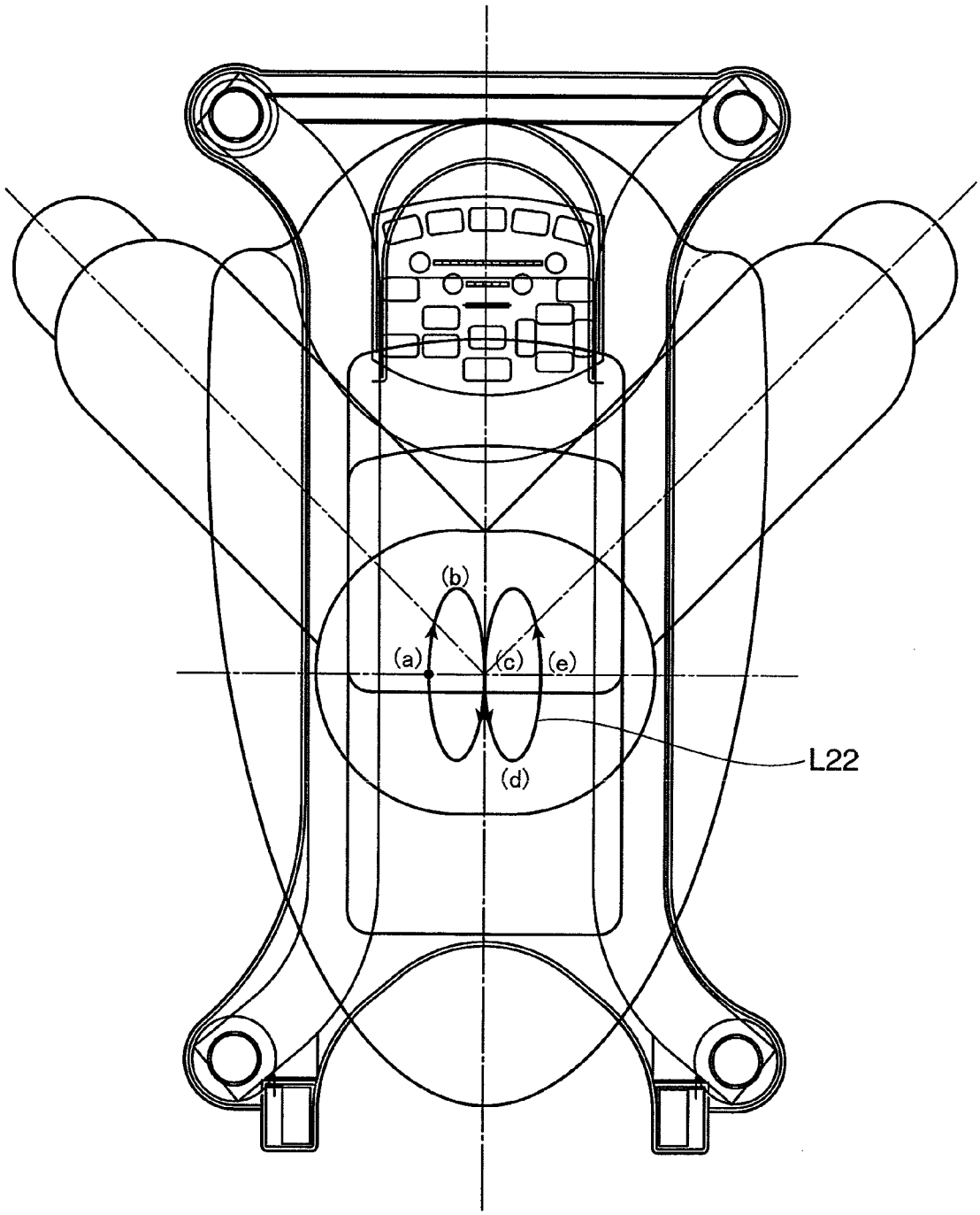
FIG. 16 is a top plan view showing a seat rocking locus under a condition that the gear-ratio between the first and second drive gears is 1:2, and the phase timings of their origins are shifted by 180 degrees with respect to each other.
Figure 17:
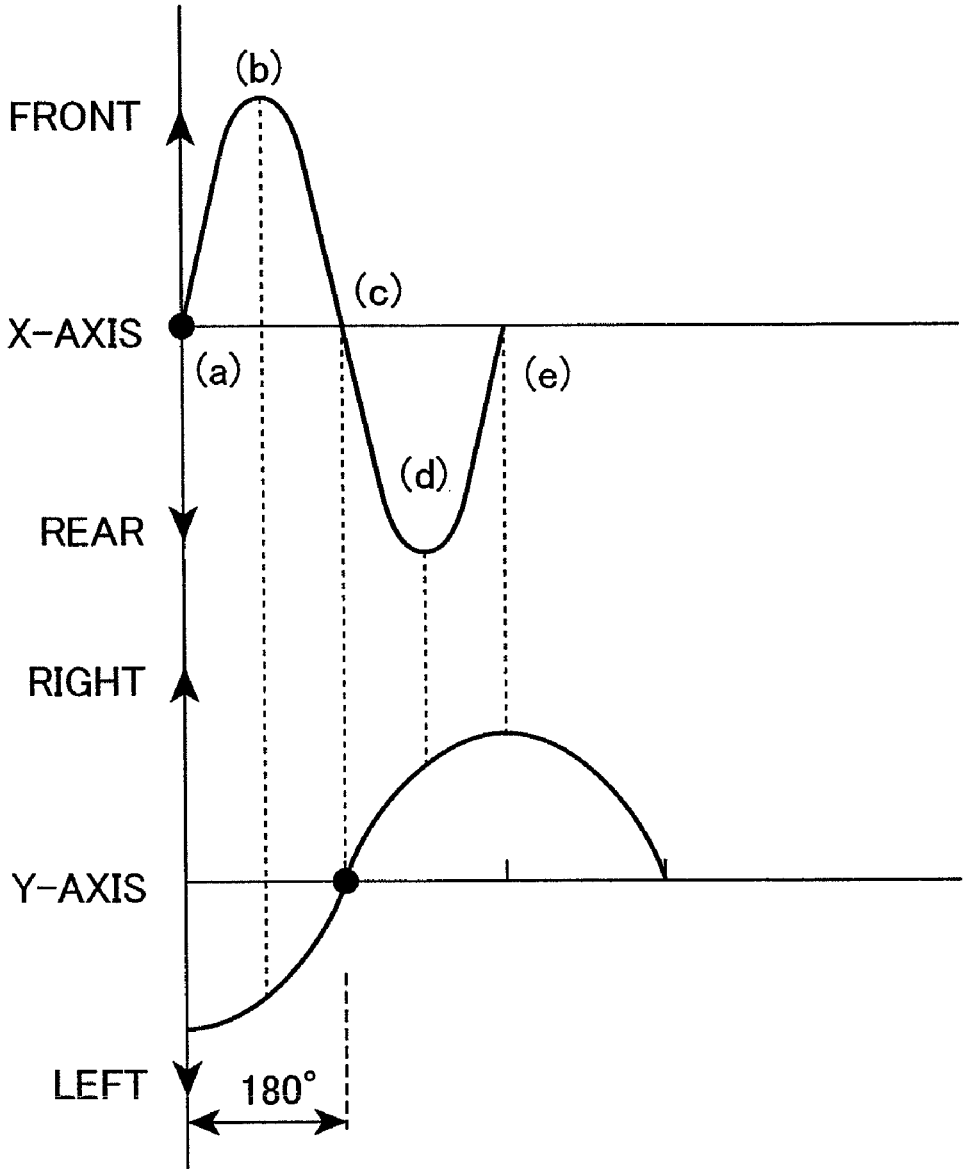
FIG. 17 is a graph showing changes in mesh engagement between the first and second drive gears under the condition shown in FIG. 16.

In this case, if the phase timings of the respective origins are shifted by 180 degrees with respect to each other, the seat 2 will be rockingly moved along a horizontal figure-of-eight shaped locus L22 (extending laterally inwardly from the outer side), as shown in FIG. 16. FIG. 17 shows a change in mesh engagement between the first drive gear 14 and the second drive gear 15 under this condition.

Figure 18:
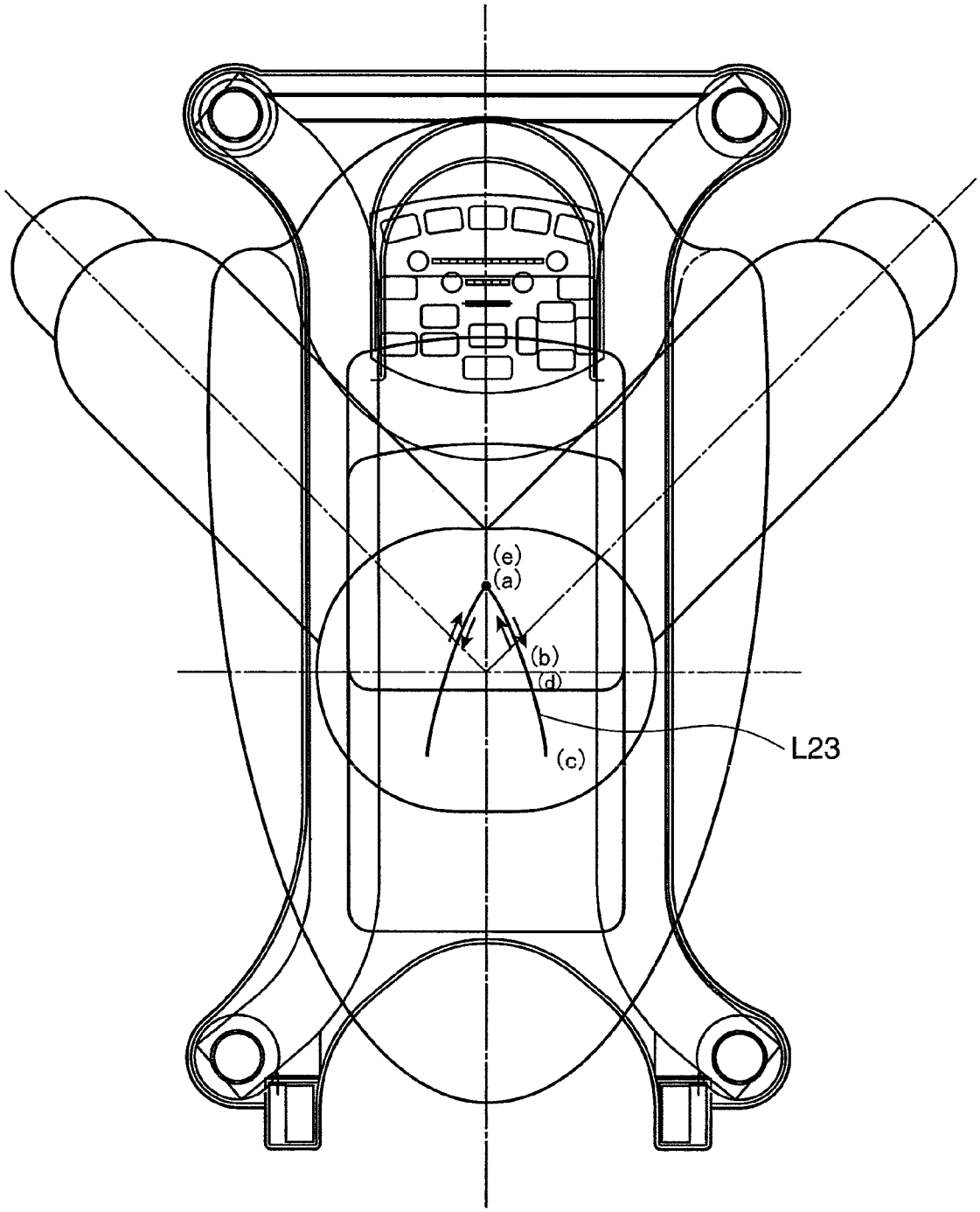
FIG. 18 is a top plan view showing a seat rocking locus under a condition that the gear-ratio between the first and second drive gears is 1:2, and the phase timings of their origins are shifted by 90 degrees with respect to each other.
Figure 19:
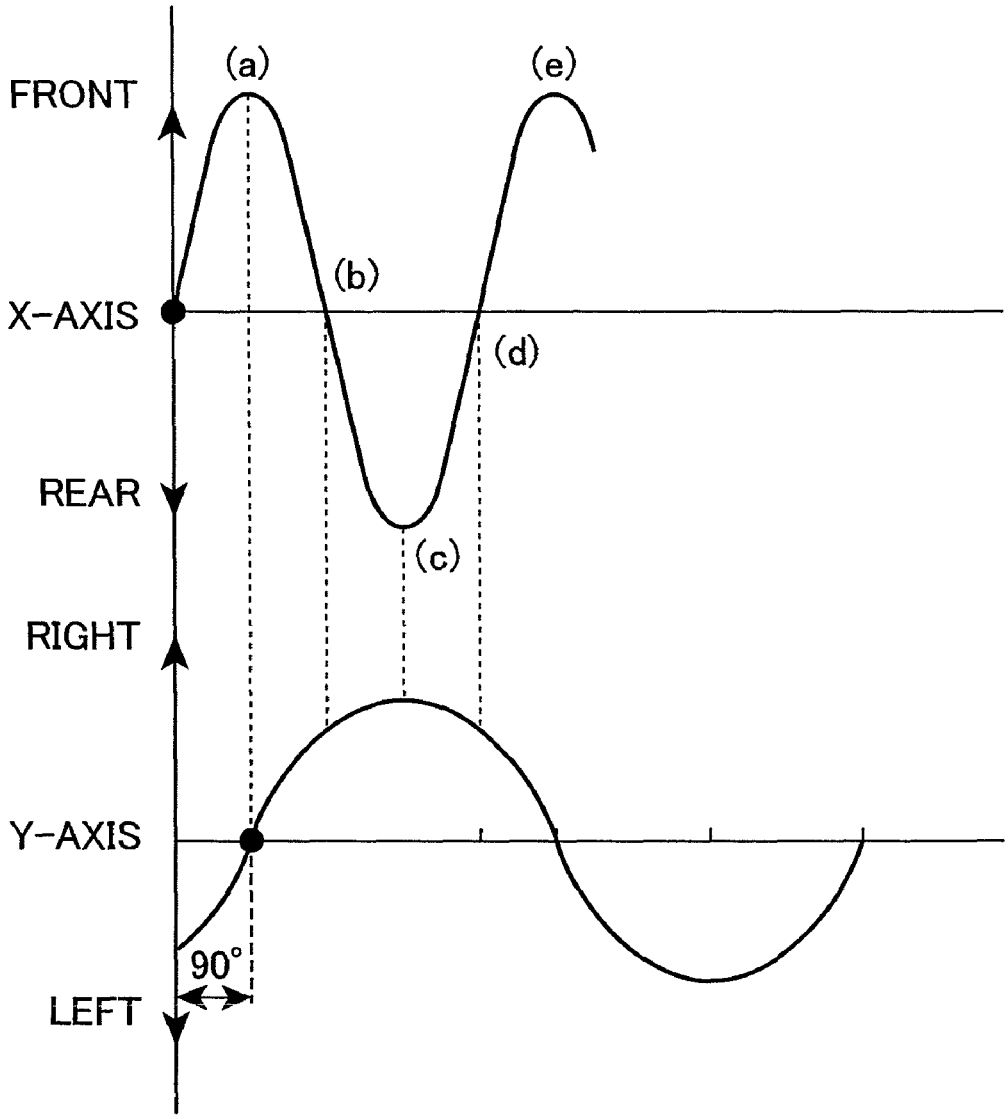
FIG. 19 is a graph showing changes in mesh engagement between the first and second drive gears under the condition shown in FIG. 18.
Figure 20:
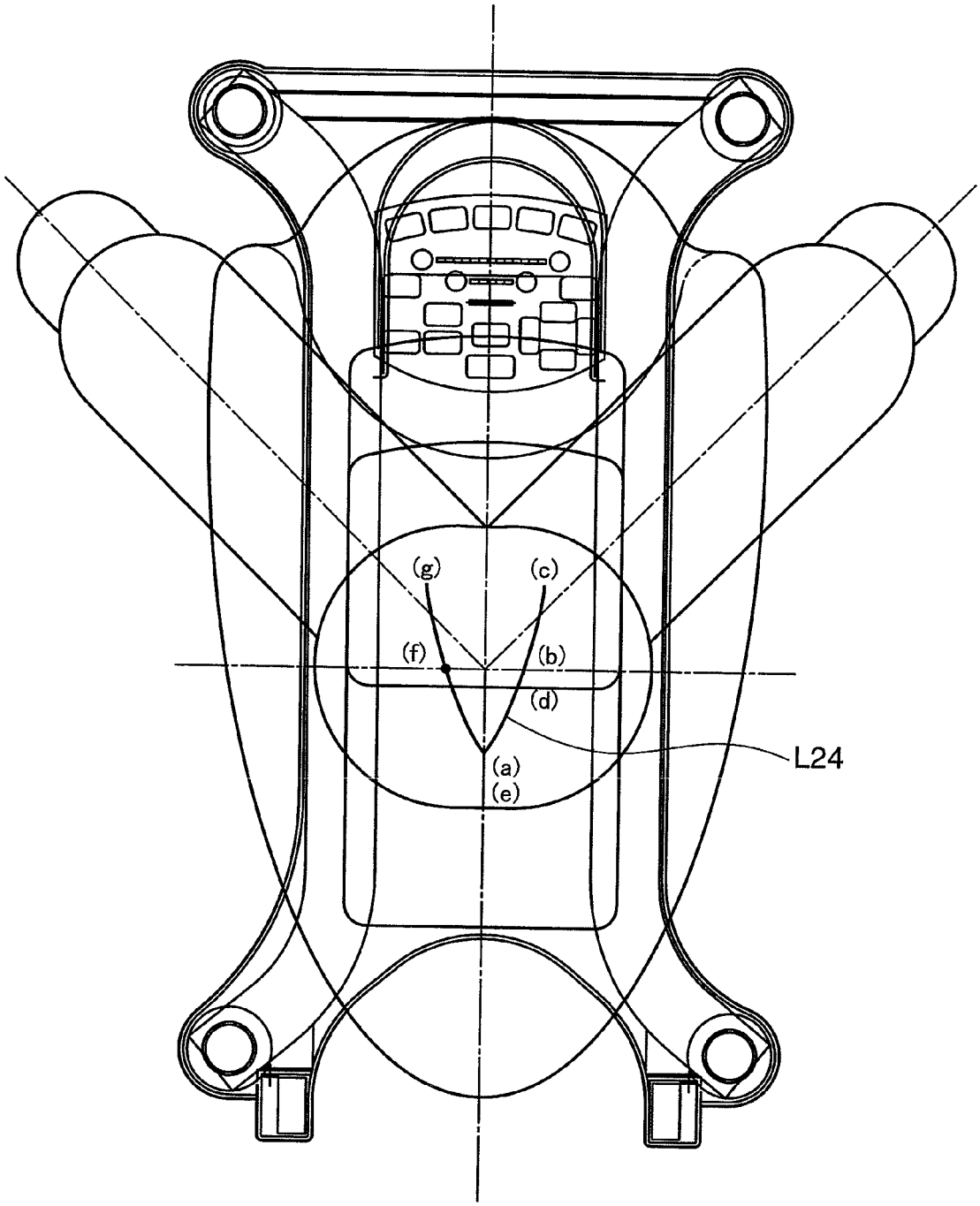
FIG. 20 is a top plan view showing a seat rocking locus under a condition that the gear-ratio between the first and second drive gears is 1:2, and the phase timings of their origins are shifted by 270 degrees with respect to each other.
Figure 21:
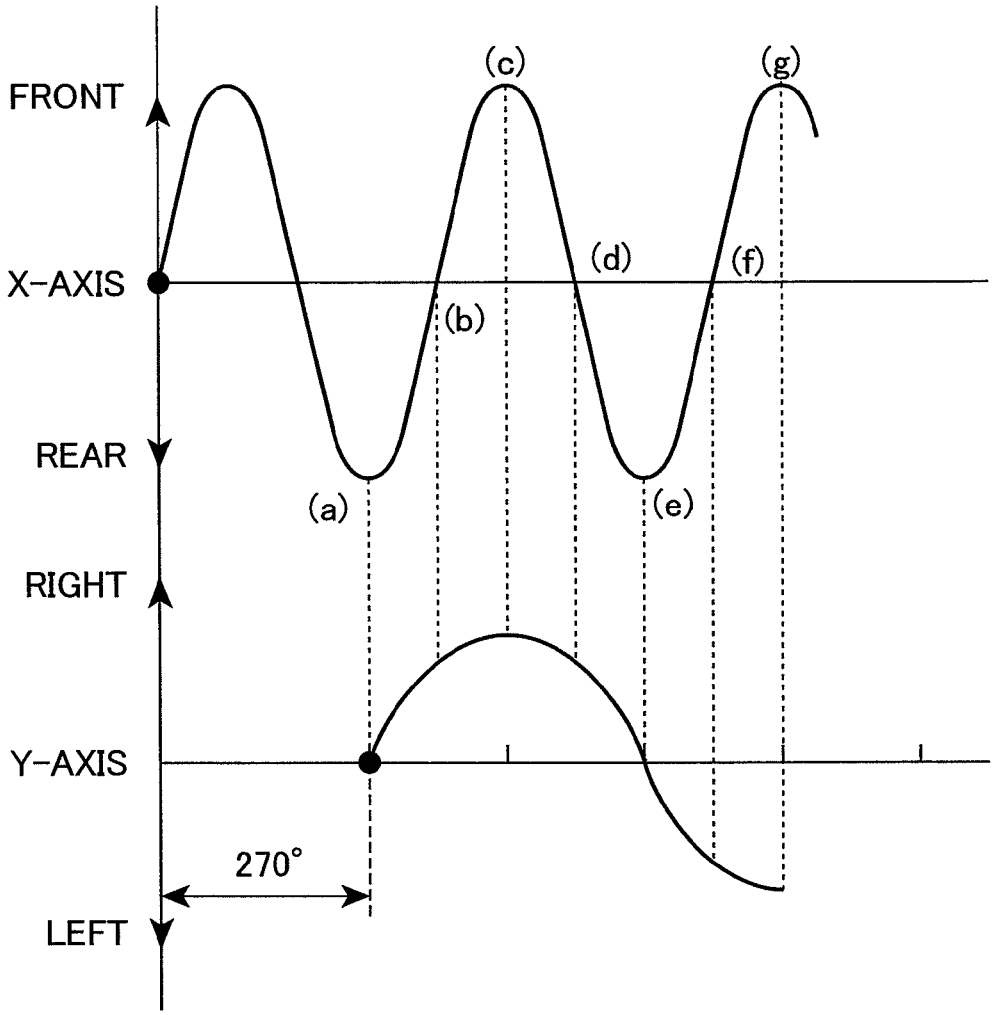
FIG. 21 is a graph showing changes in mesh engagement between the first and second drive gears under the condition shown in FIG. 20.

Further, if the phase of the second drive gear 15 is delayed by 90 degrees relative to the phase of the first drive gear 14, the seat 2 will be rockingly moved along an inverted V-shaped locus L23 in top plan view, as shown in FIG. 18. FIG. 19 shows a change in mesh engagement between the first drive gear 14 and the second drive gear 15 under this condition. If the phase of the second drive gear 15 is advanced by 90 degrees (delayed by 270 degrees) relative to the phase of the first drive gear 14, the seat 2 will be rockingly moved along a V-shaped locus L24 in top plan view, as shown in FIG. 20. FIG. 21 shows a change in mesh engagement between the first drive gear 14 and the second drive gear 15 under this condition.

Figure 22:
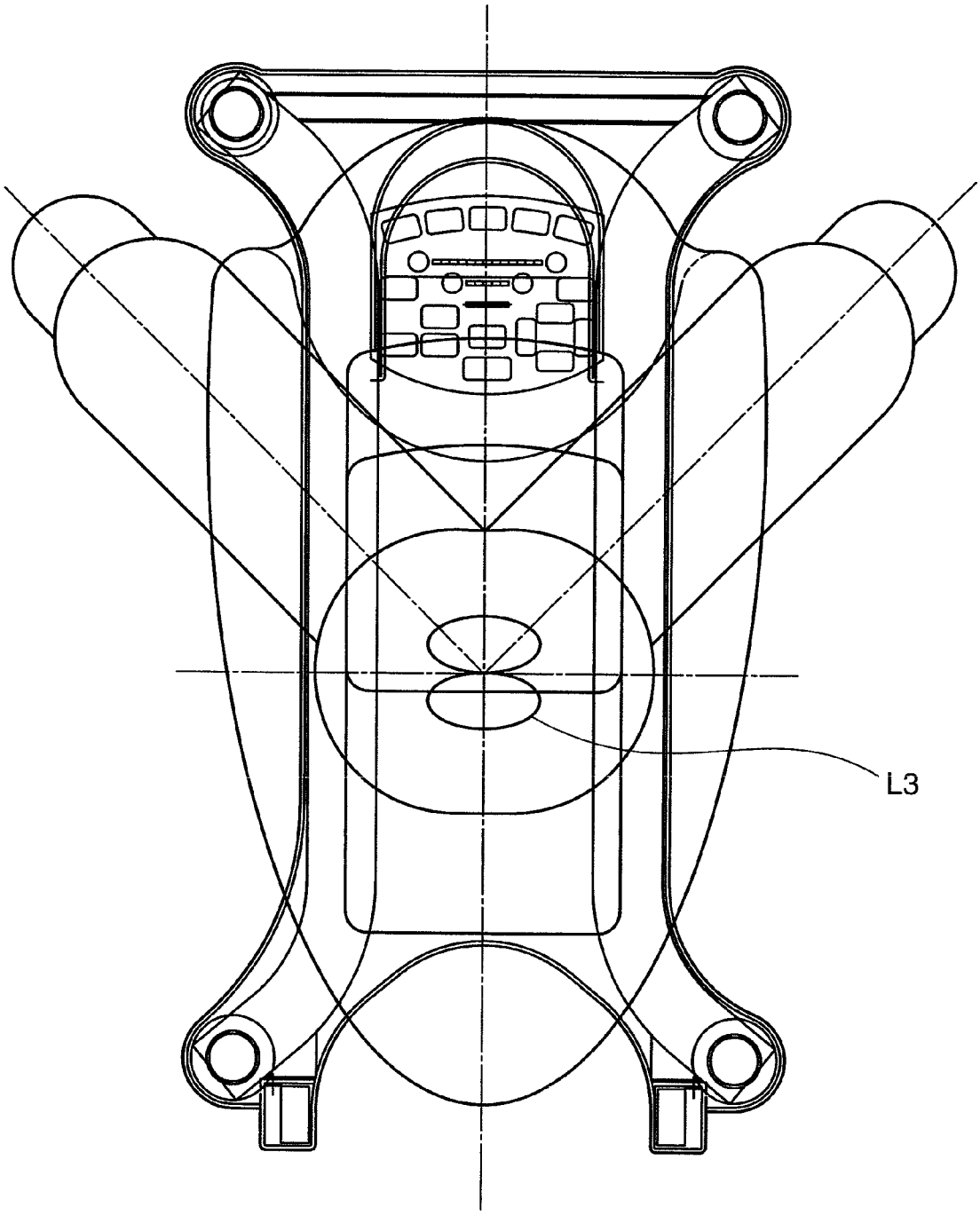
FIG. 22 is a top plan view showing a seat rocking locus under a condition that the gear-ratio between the first and second drive gears is 2:1, and the phase timings of their origins are coincident with each other at zero degree.

When the gear-ratio of the gear 14*b*1 of the first drive gear 14 to the gear 15*a*1 of the second drive gear 14 is set at 2:1, the rotation-number ratio is 1:2. In this case, if the phase timings of the respective origins of the two gears are coincident with each other at zero degree, the seat 2 will be rockingly moved along a vertical figure-of-eight shaped locus L3 in top plan view according to a swing movement of the eccentric rod 21, as shown in FIG. 22.

In the above cases, the third eccentric shaft 22*a* serving as the swing support point of the eccentric rod 21 is set at a position causing no offset in the swing movement of the rocking mechanism 3 about the swing axis 11*z*. If there is such an offset, each of the above loci L1, L21, L22, L23, and L3 will appear with a certain deviation in a direction of the offset, as described in detail latel Further, in the above cases, the swing axis 11*z* is set in a horizontal position. Alocus in cases where the swing axis 11*z* is tilted will also be described later.

Figure 23:
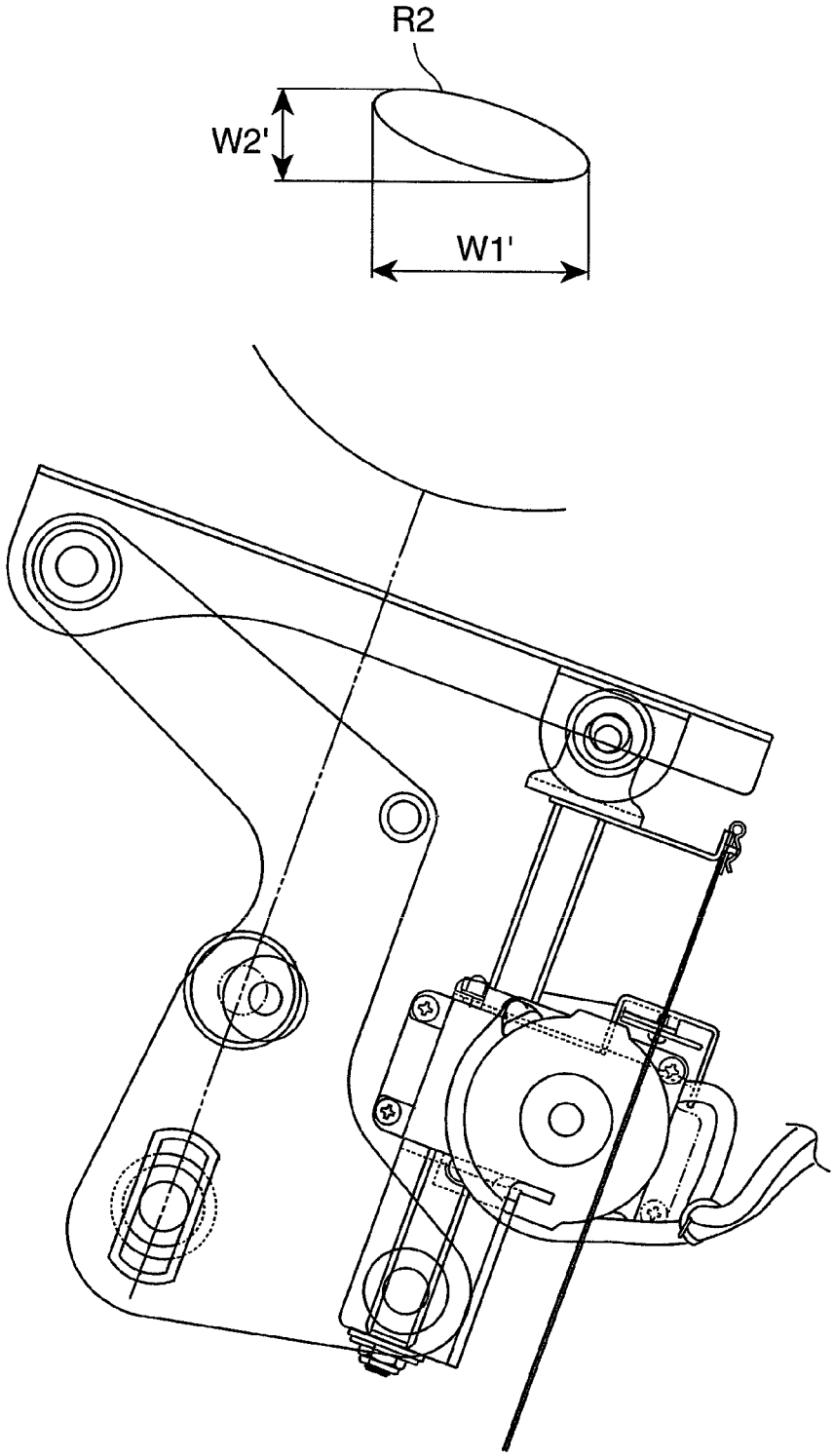
FIG. 23 is a side view showing a seat rocking locus under a condition that only a first telescopic lift for tilting the rocking mechanism is extended.
Figure 24:
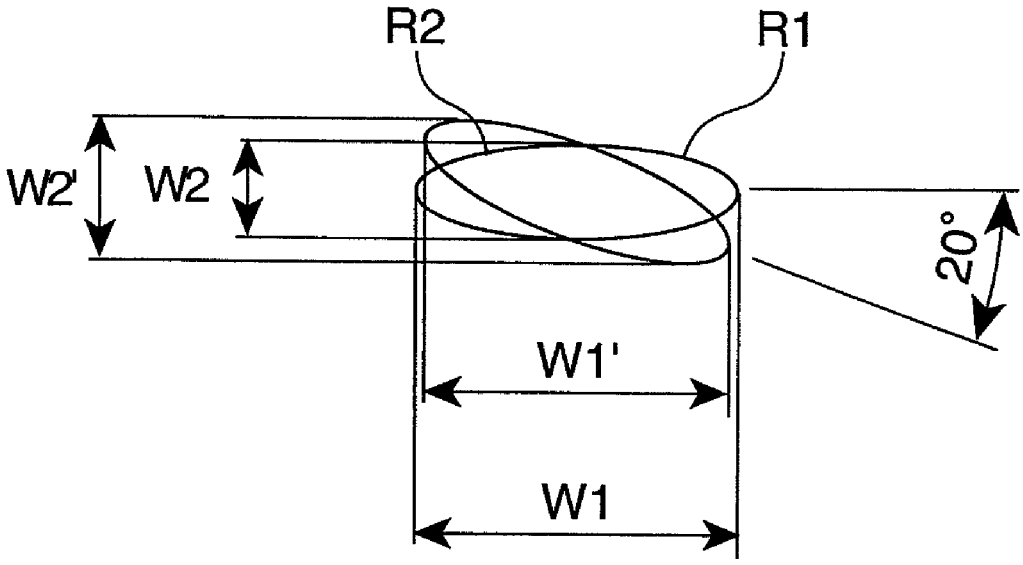
FIG. 24 is a side view for comparing between the seat rocking loci shown in FIGS. 9 and 23.

The above loci are obtained under the condition that the longitudinal direction of the elongate holes 17*b*, 18*b* is set in a vertical direction. The following description will be made about another example where the aforementioned rocking operation is performed under a condition that either one of the first and second telescopic lifts 12, 20 is extended or retracted without extending and retracting the other telescopic lift. For example, when the first telescopic lift 12 is extended, the seat 2 is forwardly tilted in response to an upward swing movement of the holding member 11. Thus, according to the first eccentric shafts 14*c*, 14*d* of the first drive gear 14, the up-and-down levers 17, 18 and the restriction shaft 16, the seat 2 will be rockingly moved along a forwardly-tilted elliptic locus R2 in side view, as shown in FIG. 23. In this case, according to an increase in tilt angle of the seat 2, a longitudinal (X-axial) component and a vertical (Z-axial) component will be gradually interchanged for each other. Then, as shown in FIG. 24, when the seat 2 is tilted at a certain angle or more, a vertical stroke W2 of the elliptic locus is increased to W2' while a vertical stroke W1 is reduced to W1', as compared with the locus R1 illustrated in FIG. 9. In this manner, the amplitude of the locus (R1, R2) can also be changed.

As shown in FIG. 25, the tilt angle of the seat 2 can also be changed by extending or retracting the second telescopic lift 20. In this case, a distance H1 between the rocking mechanism 3 (specifically, an axial center of the restriction shaft 16 serving as a support point of the rocking movement) and the seat 2 (a center of the rocking motion (rocking center) of the mount member 19) will be changed to H1'. Thus, when the longitudinal direction of the elongate holes 17*d*, 18*d* is set in the vertical direction as shown in FIG. 25, the horizontal stroke W1 is changed to W1" without a change in the vertical stroke W2. Additionally, a distance between the swing axis 11*z* serving as a support point of the swing movement and the seat 2 (the rocking center of the mount member 19), and thereby the lateral (Y-axial) stroke is changed.

In the above manner, the first and second telescopic lifts 12, 20 can be selectively extended and retracted to change the rocking strokes. Further, as the second telescopic lift 20 is more extended, the front portion of the seat 2 will be further spaced apart from the swing axis 11*z*, so that a rocking stroke (after-mentioned rolling and yawing) corresponding to the swing movement about the swing axis 11*z* can be increased. While a subject, such as an elderly person or a physically feeble person, has used a conventional balance training apparatus at a reduced rocking speed, the apparatus according to this embodiment can cope with such a need by changing the rocking strokes so as to allow the subject to take exercise without anxiety. Further, according to need, the strokes can be increased. This makes it possible to achieve a balance training apparatus capable of offering exercise suitable for subject's physique, physical condition, age, gender, physical strength, etc., and providing excellent effects of exercise.

In addition, the first and second telescopic lifts 12, 20 can be selectively extended and retracted in an interlocked relation with each other to move the seat 2 up and down while changing the locus and stroke of the rocking motion of the seat 2 as described above. This makes it possible to increase diversity in balance training and generate enhanced realistic sensation so as to achieve training menus capable of keeping subjects interested.

Figure 26:
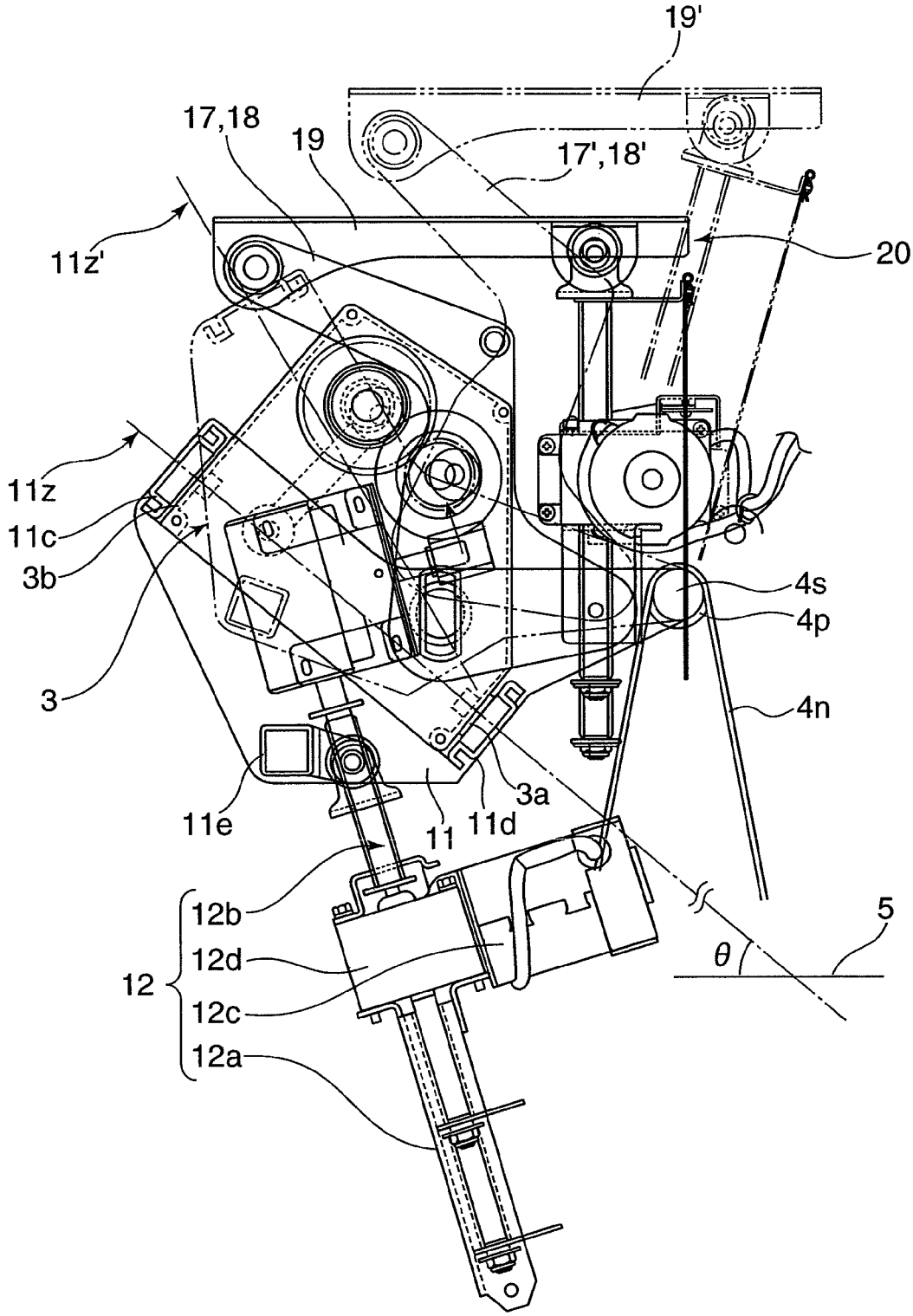
FIG. 26 is a side view showing a displacement of each portion under a condition that the rocking mechanism is tilted without tilting the seat.

The first and second telescopic lifts 12, 20 can also be selectively extended and retracted in an interlocked relation with each other to change the tilt angle of the swing axis 11*z* in a plane in the range of the longitudinal (X-axis) direction to the vertical (Z-axis) direction without changing the angle of the seat 2 (mount member 19). Specifically, on the basis of a reference position where a tilt angle θ of the swing axis 11*z* relative to the floor 5 is 45 degrees in FIG. 26, when the first telescopic lift 12 is retracted from the reference position, the swing axis 11*z* will be displaced to come closer to its horizontal position. Reversely, when the first telescopic lift 12 is extended, the swing axis 11*z* will be displaced to come closer to its vertical position (stand upright). In FIG. 26, each of the holding member 11, the rocking mechanism 3, the up-and-down levers 17, 18 and the mount member 19 at the reference position is indicated by solid lines. Further, each of these components in a state after the swing axis 11*z* is tilted to the vertical position is indicated by two-dot chain lines, and a dash is added to each of the reference codes of the components.

As the swing axis 11*z* is displaced from the horizontal (X-axial) position to come closed to the vertical (Z-axial) position (stand upright) (i.e., as the tilt angle θ becomes greater), a rocking motion corresponding to the swing movement about the swing axis 11*x* based on the second drive gear 15, the eccentric rod 21, etc., can be changed from a lateral (Y-axial) rocking motion about a (rolling) to a rocking motion about an approximately vertical axis (Z-axis) or twisting (yawing when the rocking center of the seat 2 is located on the swing axis 11*z*). Further, a longitudinal (X-axial) reciprocating motion based on the rocking mechanism 3 can be changed to a vertical (Z-axial) reciprocating motion. This makes it possible to change a motion pattern, and additionally change a range of each of the strokes along with the change in motion pattern so as to obtain a motion pattern conforming to a subject's body region to be trained, and increase diversity in motion pattern so as to achieve a highly user-friendly balance training apparatus capable of keeping subjects interested to facilitate a continuing use.

The following Table 1 shows one example of a change in rocking angle according to a change in the tilt angle θ. This rocking angle is varied depending, for example, on an eccentric amount of the second eccentric shaft 15*b* of the second drive gear 15, a length of the eccentric rod 21, and a distance between the swing axis 11*z* and the shaft 22.

TABLE 1

| Angle θ between longitudinal tilt axis and floor (degree) | Lateral Rolling Angle (degree) | Lateral Twisting (Yawing) Angle (degree) |
|---|---|---|
| 0 | 9.6 | 0 |
| 30 | 8.3 | 4.8 |
| 45 | 6.8 | 6.8 |
| 60 | 4.8 | 8.3 |
| 90 | 0 | 9.6 |

As the swing axis 11*z* is gradually displaced from the horizontal position (θ=zero degree) to gradually stand up, the lateral (Y-axial) rocking motion (rolling) is gradually changed to the rocking motion about the vertical axis (Z-axis), as described above. Thus, for example, when the gear-ratio of the gear 14*b*1 or 14*b*2 of the first drive gear 14 to the gear 15*a*1 or 15*a*2 of the second drive gear 14 is set at 1:2, the horizontal figure-of-eight shaped locus L21 as shown in FIG. 14 becomes smaller as indicated by the reference code L21' in FIG. 27. Instead, a twisting motion as indicated by the reference codes V1, V2 is added. This twisting motion is varied depending on the timing of the mesh engagement between the first drive gear 14 and the second drive gear 15. Specifically, under the condition that the phase timings of the two gears are set to be coincident with each other at a reference position P0 (displacement: zero) (i.e., a phase position of zero degree (origin) in the second drive gear 15 is adjusted to conform to a phase position of zero degree (origin) in the first drive gear 14, as the rolling stroke is increased in the lateral direction, the seat 2 is more largely twisted in a direction of the rolling motion as indicated by the reference code V1. Then, as the rolling stroke comes closer to the original reference position P0, a twisting motion in a direction opposite to the V1 is gradually weakened to release the seat 2 from twisting. This makes it possible to provide further enhanced effects of exercise.

In the above case where the gear-ratio is 1:2, if the phase position of zero degree in the second drive gear 15 is adjusted to conform to a phase position of 180 degrees in the first drive gear 14, the locus will be changed to the locus L22 as shown in FIG. 16, although a horizontal figure-of-eight shape is fundamentally maintained. In this case, in contrast to the above case, as the rolling stroke is increased in the lateral direction, the seat 2 is more largely twisted in a direction opposite (counter) to that of the rolling motion as indicated by the reference code V2. Then, as the rolling stroke comes closer to the original reference position, a twisting motion in a direction opposite to the V2 is gradually weakened to release the seat 2 from twisting. This makes it possible to provide soft or mild exercise.

When the locus has a V shape as shown in FIG. 20, as the rolling stroke is increased in the lateral direction, the seat 2 is more largely twisted in a direction of the rolling motion as indicated by the reference code V1.

Additionally, the first and second telescopic lifts 12, 20 can be interlockingly operated to change a height position of the seat 2 relative to the floor 5 while cancelling the tilt of the seat 2 which otherwise occurs due to the extension/retraction thereof. This makes it possible to set the height position of the seat 2 depending on a body height of a subject and allow a subject to easily get on/off the seat 2, without additionally providing means for moving the seat 2 up and down.

In cases where the seat 2 is kept in its tilted position to locally provide enhance effect of exercise, the second telescopic lift 20 may not be operated to cancel the tilt of the seat 2 which otherwise occurs due to the extension/retraction of the first telescopic lift 12, i.e., may be operated to tilt the seat 2 by a desired angle. Further, if the seat 2 is mounted onto the mount member 19 in a state after it is rotated at 90 degrees with respect to the mount member 19, a rocking motion based on the rocking mechanism 3 will comprise a lateral (Y-axial) rocking motion (reciprocating motion) and a vertical (Z-axial) reciprocating motion, and a locus of the seat 2 when views in the longitudinal direction will have the aforementioned elliptic shape. Further, a rocking motion based on the second drive gear 15, the eccentric rod 21 and other associated components will comprise a longitudinal (X-axial) rocking motion (pitching motion) about a lateral axis (Y-axis). The seat 2 may also be mounted onto the mount member 19 in a state after it is rotated at 180 degrees with respect to the mount member 19, i.e., in a back-to-front direction. In this manner, the mounting direction of the seat 2 relative to the rocking mechanism 3 may be appropriately determined depending on intended purposes of the balance training apparatus 1.

Figure 27:
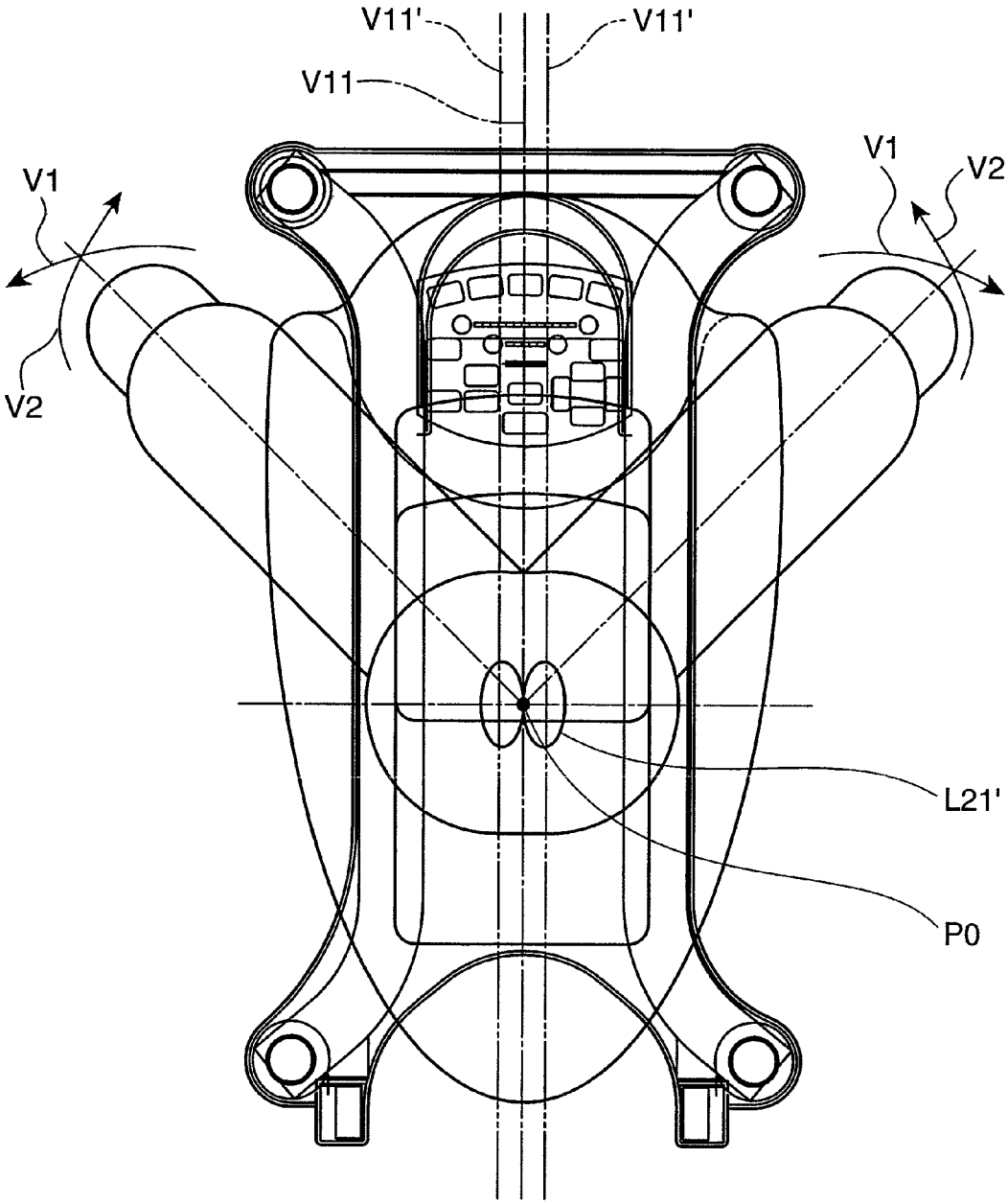
FIG. 27 is a top plan view showing changes in seat rocking pattern caused by the tilt motion of the rocking mechanism.
Figure 28:
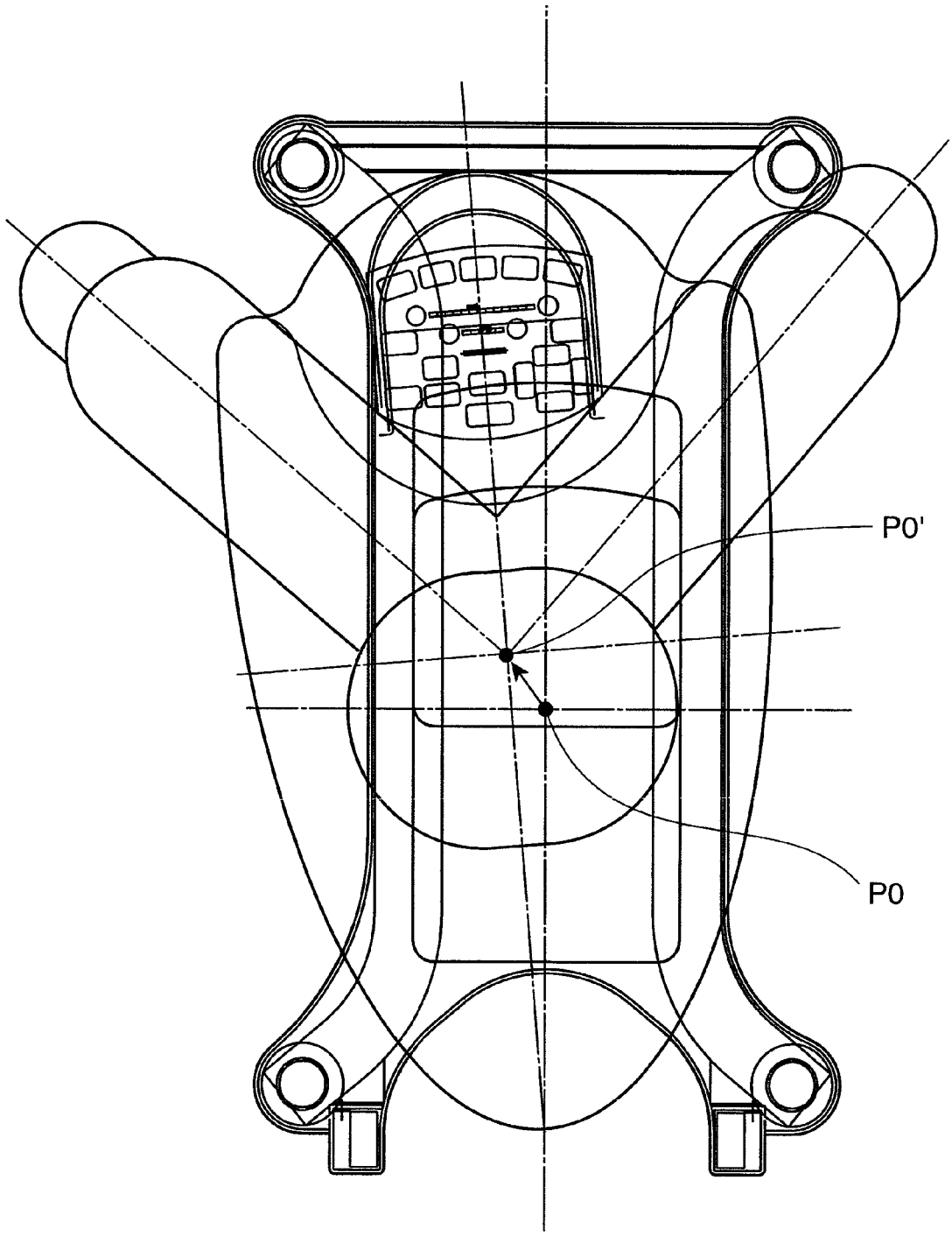
FIG. 28 is a top plan view showing changes in seat rocking pattern by offset between rightward and leftward rocking motions.
Figure 29:
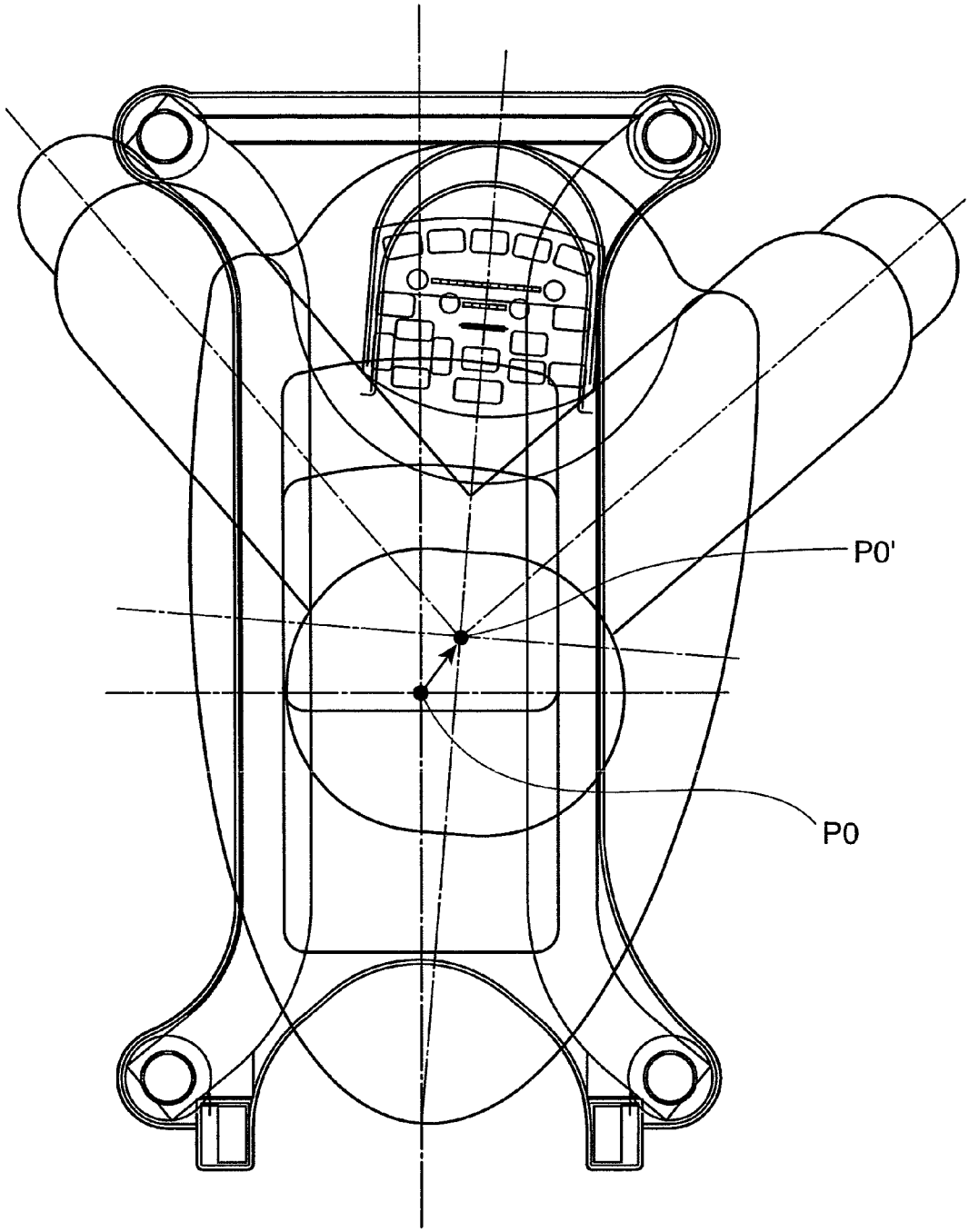
FIG. 29 is a top plan view showing changes in seat rocking pattern by offset between rightward and leftward rocking motions.

In the above embodiment, the gear 23 is adapted to be rotated by the motor 24. Thus, according to rotation of the gear 23, the third eccentric shaft 22*a* integral with the gear 23 is rotated. Then, when the swing support point of the eccentric rod 21 is moved to a lowermost position by the eccentric shaft 22*a*, i.e., the eccentric rod 21 is at a bottom dead center, and when the swing support point of the eccentric rod 21 is moved to an uppermost position by the eccentric shaft 22*a*, i.e., the eccentric rod 21 is at a top dead center, the rocking mechanism 3 has a maximum offset about the swing axis 11*z*. Therefore, when the tilt angle θ has approximately zero degree, and thereby the rocking motion has some twisting (yawing) motion, the reference position of the rocking motion is shifted from the P0 to P0', as shown in FIGS. 28 and 29. FIG. 28 shows the P0' to be obtained when the swing support point of the eccentric rod 21 is moved to the lowermost position by the eccentric shaft 22*a*, wherein the reference position of the rocking motion is offset leftwardly. FIG. 29 shows the P0' to be obtained when the swing support point of the eccentric rod 21 is moved to the uppermost position by the eccentric shaft 22*a*, wherein the reference position of the rocking motion is offset rightwardly. When the tilt angle θ is zero degree and therefore the rocking motion has no twisting (yawing) motion, an axis of a rocking motion is shifted leftwardly or rightwardly, specifically from the axis V11 to the axis V11' as shown in FIG. 27.

In this manner, a locus of the seat 2 can be tilted about the swing axis 11*z* or the longitudinal axis (X-axis) to provide a difference in lateral rolling angle, lateral twisting angle and/or amount of lateral linear movement between right and left sides of the seat 2. This makes it possible to locally train a specific muscle, such as lateral muscle or adductor muscle, so as to correct a lateral distortion in a body of a subject to improve his/her posture, and efficiently improve his/her physical strength. In addition, his/her balance abilities can be improved. Further, the motor 24 may be continuously rotated to continuously change the tilt angle of the rocking mechanism 3 about the swing axis 11*z* so as to diversify the motion pattern to achieve a highly user-friendly balance training apparatus capable of keeping subjects interested to facilitate a continuing use.

Teeth of the worm 13*b* may be formed in any of clockwise and counterclockwise directions depending on respective rotation directions of the motor 13 and the first and second drive gears 14, 15. In the above embodiment, the teeth of the worm 13*b* are formed in a direction allowing a force to be applied from the worm wheel 14*a* to the worm 13*b* in a direction for press-fitting the worm 13*b* onto the output shaft 13*a* (i.e., in a direction toward the motor 13) when the seat 2 is pressed downwardly by a load (i.e., when the first drive gear 14 is driven in a reverse rotation direction due to the load). This makes it possible to prevent the seat 2 from being suddenly lowered due to falling-off of the worm 13*b* from the output shaft 13*a* when the seat 2 is pressed downwardly by a load, such as a body weight of a subject.

Figure 30:
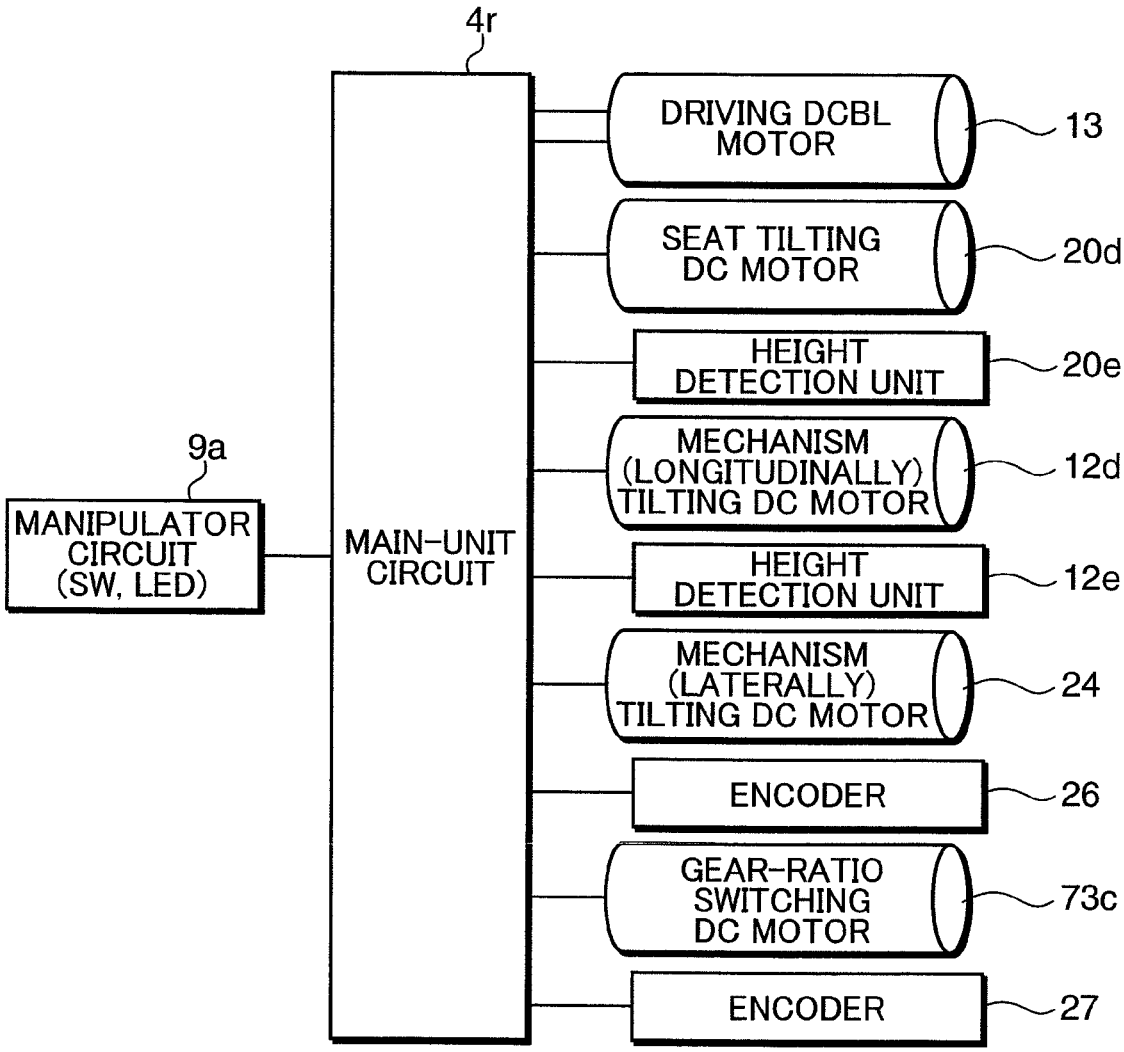
FIG. 30 is a block diagram showing an electrical configuration of the balance training apparatus.

FIG. 30 is a block diagram showing an electrical configuration of the balance training apparatus 1. In response to a manipulation from the manipulator circuit board 9*a*, the main-unit circuit 4*r* is operable to drive the rocking-motion motor 13 such as a DC brushless motor, the seat tilting motor 20*d* such as a DC motor, the mechanism longitudinally-tilting (up-and-down) motor 12*d* such as a DC motor, the mechanism laterally-tilting motor 24 such as a DC motor, and the gear-ratio switching motor 73*c* such as a DC moto.

A tilt angle of the mount member 19 (seat 2) relative to the rocking mechanism 3 based on the seat tilting motor 20*d* is detected by the height detection unit 20*e*. A tilt angle of the holding member 11 (rocking mechanism 3) relative to the leg column 4*b* based on the mechanism longitudinally-tilting (up-and-down) motor 12*d*, i.e., the tilt angle θ of the swing axis 11*z* is detected by the detection unit 12*e*. A tilt angle of the rocking mechanism 3 relative to the holding member 11 based on the mechanism laterally-tilting motor 24 is detected by the encoder 26. Respective zero-degree phase timings of the first drive gear 14 and the second drive gear 15 are detected by an encoder 75. The above detection results are input into the main-unit circuit 4*r*.

Figure 31:
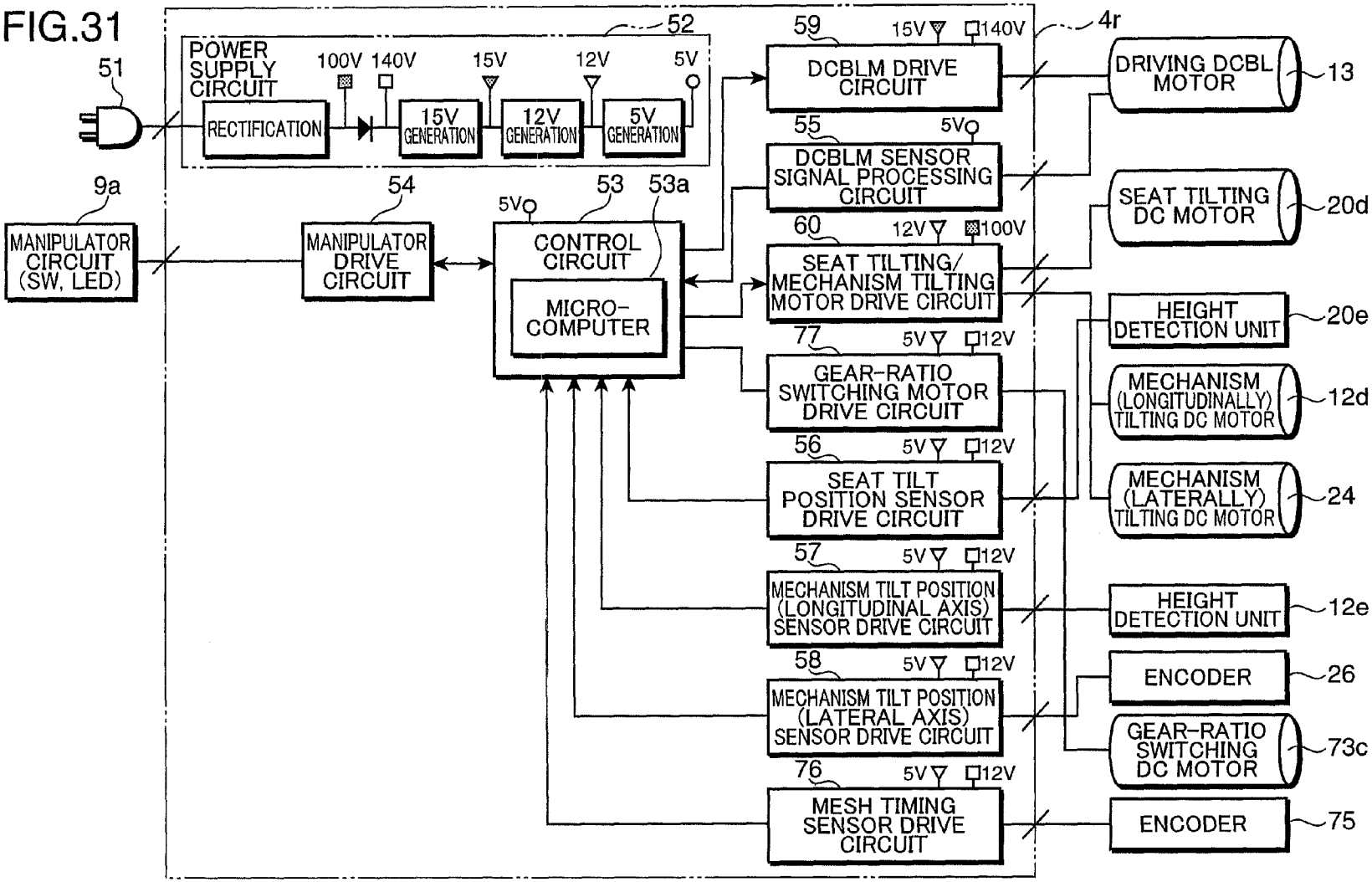
FIG. 31 is a block diagram showing an electrical configuration of a main-unit circuit board.

FIG. 31 is a block diagram showing an electric configuration of the main-unit circuit 4*r*. A commercial AC power input from a power plug 51 is converted to a plurality of DC voltages, such as 140V, 100V, 15V, 12V and 5V, through a power supply circuit, and the converted voltages are supplied to each circuit in the main-unit circuit 4*r*. Various operations in the main-unit circuit 4*r* are controlled by a control circuit 53 including a microcomputer 53*a*. Specifically, the control circuit 53 is operable to instruct the manipulator circuit 9*a* to display information through a manipulator drive circuit 54, and accept an input from the manipulator circuit 9*a*. In response to the input from the manipulator circuit 9*a*, a rotational angle/position and a rotational speed of the rocking-motion motor 13 input through a sensor signal processing circuit 55, and the detection results of the height detection units 20*e*, 12*e* and encoders 26, 75 input through sensor drive circuits 56, 57, 58, 76, the control circuit 53 is operable to drive the rocking-motion motor 13 through a drive circuit 59, and drive the tilting motors 20*d*, 12*d*, 24 through a drive circuit 60. The control circuit 53 is also operable to drive the gear-ratio switching motor 73*c* through a drive circuit 77.

A notable feature of the driving control is that the control circuit 53 is operable to instruct the motor 73*c* to switch a mesh engagement timing and gear-ratio between the first drive gear 14 and the second drive gear 15. For this switching control, first and second rotation plates 14*r*, 15*r* are attached, respectively, to the first and second drive gears 14, 15. The first and second rotation plates 14*r*, 15*r* are formed, respectively, with first and second pits 14*v*, 15*v* marked corresponding to zero-degree phase positions of the first and second drive gears 14, 15. The first and second pits 14*v*, 15*v* are sensed to detect the zero-degree phase timings and the rotational speeds of the first and second drive gears 14, 15.

Thus, the control circuit 53 is operable, in response to detection of the zero-degree phase timing of the second drive gear 15, to move the eccentric cam 72 to the neutral position so as to cut off the transmission of the driving force from the first drive gear 14 to the second drive gear 15, and, after rotating the first drive gear 14 by a desired shift angle relative to the zero -degree phase timing, rotate the eccentric cam 72 in such a manner as to mesh one of the gears 15*a*1, 15*a*2 which corresponds to a desired gear-ratio, with the shaft portion 15*x*. In this manner, the first and second drive gears 14, 15 can be meshed with each other in any phase relationship, and the gear-ratio can be changed.

Thus, for example, the gear-ratio can be switched between 1:2 and 2:1 for a horizontal figure-of-eight shaped locus. Further, a V-shaped or inversed V-shaped locus can be formed at a gear-ratio of 1:2. In this manner, a variety of rocking motions can be obtained by changing a rocking locus of the seat 2 and an allocation of physical exercise (allocation of the rocking motions depending on a target muscle and a desired training level). This makes it possible to achieve a highly user-friendly balance training apparatus capable of keeping subjects interested to facilitate a continuing use.

As above, the balance training apparatus is provided with a rocking mechanism which includes a plurality of converters adapted to receive a driving force transmitted from a common driving source so as to operate in an interlocked relationship with each other, and convert the driving force from the driving source to a rocking motion having movement directions intersecting with each other, and designed to rockingly move a seat with a subject thereon based on the rocking mechanism. The balance training apparatus comprises a phase changer adapted to selectively connect and disconnect the transmission of the driving force to first converter consisting of a part of the plurality of converter, so as to change a phase relationship in rocking motion between the first converter, and second converter consisting of the rest of the plurality of converter.

In the above balance training apparatus, the rocking mechanism is operable to rockingly move the seat with a subject thereon so as to apply an exercise load simulating horse riding to the subject to facilitate the training of his/her balance abilities. The rocking mechanism comprises the plurality of converter associated with the driving source. Specifically, the plurality of converter is adapted to receive a driving force transmitted from the driving source, such as a common motor, by means of a gear, a rack belt or the like without slip, so as to operate in an interlocked relationship with each other (without occurrence of phase shift), and convert the driving force from the driving source to a rocking motion having movement directions intersecting with each other. In a conventional balance training apparatus, the phase relationship in rocking motion, i.e., a timing of mesh engagement, between the first and second converter, is generally fixed. In contrast, the balance training apparatus includes the phase changer adapted to selectively connect and disconnect the transmission of the driving force to the first converter so as to change a phase relationship in rocking motion between the first converter, and the second converter.

Given that each of the first and second converter consists a single conversion device, wherein first and second conversion devices are adapted to generate a longitudinal (X-axial) rocking motion and a lateral (Y-axial) rocking motion, respectively, and cycle ratio, i.e., gear-ratio, between the first conversion device for the longitudinal rocking motion and the second conversion device for the lateral rocking motion is set at 1:2. If respective origins of the longitudinal (X-axial) rocking motion and the lateral (Y-axis) rocking motion are coincident with each other, i.e., zero-degree phase timings of respective gears of the first conversion device for the longitudinal rocking motion and the second conversion device for the lateral rocking motion are coincident with each other, the seat will be rockingly moved along a horizontal (Y-axial) figure-of-eight shaped locus in top plan view. In this case, if a phase timing of ¾ cycle of the longitudinal (X-axial) rocking motion is coincident with the origin of the lateral (Y-axis) rocking motion, i.e., the zero-degree phase timing of the gear of the second conversion device for the lateral rocking motion is coincident with 270-degree phase timing of the gear of the first conversion device for the longitudinal rocking motion, the seat will be rockingly moved along a V-shaped locus in top plan view.

Thus, a phase in rocking motion of the first converter can be changed in the above manner to provide a variety of rocking motions while adequately adjusting a rocking locus of the seat and an allocation of physical exercise (allocation of the rocking motions depending on a target muscle and a desired training level or exercise intensity). This makes it possible to achieve a highly user-friendly balance training apparatus capable of keeping subjects interested to facilitate a continuing use.

In the balance training apparatus, the driving force from the driving source to the plurality of converter may be transmitted by means of a gear, and the first converter may include a clutch device adapted to selectively connect and disconnect the transmission of the driving force so as to serve as the phase changer, and a gear changer adapted to change a gear-ratio.

In this balance training apparatus, the clutch device serving as the phase changer is provided in the first converter, to selectively connect and disconnect the transmission of the driving force so as to change the rocking locus, for example, between a horizontal figure-of-eight shaped locus and a V-shaped locus as described above. In addition, the gear changer is provided in the first converter to change a gear-ratio. Thus, based on the above assumption, when the gear-ratio of the respective gears of the first conversion device for the longitudinal rocking motion and the second conversion device for the lateral rocking motion is set at 1:2, a horizontal figure -of-eight shaped locus and a V-shaped locus can be obtained as described above. In addition, when the gear-ratio is set at 2:1, a vertical figure-of-eight shaped locus can be obtained (under a condition that the zero-degree phase timing of the gear of the first conversion device for the longitudinal rocking motion is coincident with the zero-degree or 180-degree phase timing of the gear of the second conversion device for the lateral rocking motion). Further, when the gear-ratio is set at 1:1, a linear locus can be obtained (under the condition that the zero-degree phase timing of the gear of the first conversion device is coincident with the zero-degree phase timing of the gear of the second conversion device), or a circular locus can be obtained (under a condition that the zero-degree phase timing of the gear of the first conversion device is coincident with 90-degree or 270-degree phase timing of the gear of the second conversion device for the lateral rocking motion).

Thus, the rocking locus of the seat and the allocation of physical exercise can be largely changed to further increase diversity in rocking motion.

Preferably, in the balance training apparatus, the rocking mechanism includes the driving source, and a housing adapted to house the driving source. In this case, the second converter may include: a first drive gear adapted to be rotationally driven by the driving source, wherein the first drive gear is formed to have a first eccentric shaft in part, and supported by a side wall of the housing in a rotatable manner about a lateral axis; and an up-and-down member having a concave portion into which the first eccentric shaft is rotatably fitted, and a restriction member supporting the up-and-down member to the housing at a position spaced apart from the first drive gear and a mount member loaded with the seat and supported by the up-and-down member, in such a manner as to prevent the up-and-down member from being turned over about the first eccentric shaft. Further, the first converter may include: a second drive gear adapted to be rotationally driven by the first drive gear, wherein the second drive gear is formed to have a second eccentric shaft in part, and supported by a side wall of the housing in a rotatable manner about a lateral axis; an eccentric rod having one end to which the second eccentric shaft is rotatably connected; and the clutch device and the gear changer which are interposed between the first drive gear and the second drive gear. The balance training apparatus may further include a holding member which supports the rocking mechanism in a swingable manner about a predetermined longitudinal axis, and to which the other end of the eccentric rod is connected, whereby the eccentric rod is swingably moved according to rotation of the second drive gear while allowing the rocking mechanism to be swingably displaced about the rotational axis.

In this balance training apparatus, according to the rotation of the first drive gear, the up-and-down member rockingly moves the seat in an up-and-down (Z-axis) direction and in the longitudinal (X-axis) direction. Further, according to the rotation of the second drive gear, the eccentric rod allows the seat to be rockingly moved in the lateral (Y-axis) direction.

Thus, the clutch device can selectively connect and disconnect the transmission of driving force to change a phase relationship between the up-and-down (Z-axial)/longitudinal (X-axial) rocking motion and the lateral (Y-axial) rocking motion using, and the gear changer can change the gear-ratio to switchingly change a ratio between the up-and-down (Z-axial)/longitudinal (X-axial) rocking motion and the lateral (Y-axial) rocking motion, so as to achieve a variety of rocking patterns.

This application is based on patent application No. 2006-171524 filed in Japan on Jun. 21, 2006, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A balance training apparatus for applying an exercise load to a subject, comprising:

a seat to allow the subject to sit thereon;

a driving source to generate a driving force;

a rocking mechanism for rockingly moving the seat, the rocking mechanism including:

a first converter having a first drive member for receiving the driving force transmitted from the driving source and a first converting mechanism for converting the driving force from the driving source to a rocking motion having a first axis;

a second converter having a second drive member for receiving the driving force from the first drive member, and a second converting mechanism for converting the driving force from the first drive member to a rocking motion having a second axis intersecting with the first axis; and a transmitting mechanism to transmit the driving force from the first drive member to the second drive member;

a detector to detect a phase relationship between the first drive member and the second drive member; and a controller to control the transmission of the driving force from the first drive member to the second drive member based on the phase relationship detected by the detector, wherein the transmitting mechanism includes:

a first gear mechanism formed in the first drive member;

a second gear mechanism mounting on the second drive member in the shape of a shaft;

a switching member provided between the second gear mechanism and the second drive member; and a cam for actuating the switching member; and a drive mechanism for driving the cam, the drive mechanism being controlled by the controller, wherein:

the first gear mechanism includes:

a driven gear for receiving the driving force from the driving source;

a first transmitting gear for transmitting the driving force to the second gear mechanism;

a second transmitting gear for transmitting the driving force to the second gear mechanism;

the second gear mechanism includes:

a first driven gear for receiving the driving force from the first transmitting gear at a first gear ratio;

a second driven gear for receiving the driving force from the second transmitting gear at a second transmitting gear at a second gear ratio greater than the first gear ratio;

the switching member includes a cylinder which is:

mounted on the second drive member;

axially movable between the first driven gear and the second driven gear; and switchably engageable with the first driven gear and the second driven gear.

2. The balance training apparatus as defined in claim 1, wherein the controller controls the transmission of the driving force from the first drive member to the second drive member to perform one of:

a first combination of the rocking motion about the first axis and the rocking motion about the second axis at the same phase and at the same rocking speed;

a second combination of the rocking motion about the first axis and the rocking motion about the second axis at the same phase and at a different rocking speed;

a third combination of the rocking motion about the first axis and the rocking motion about the second axis at a phase timing shift of 90 degrees and at the same rocking speed;

a fourth combination of the rocking motion about the first axis and the rocking motion about the second axis at a phase timing shift of 90 degrees and at a different rocking speed;

a fifth combination of the rocking motion about the first axis and the rocking motion about the second axis at a phase timing shift of 180 degrees and at the same rocking speed; and a sixth combination of the rocking motion about the first axis and the rocking motion about the second axis at a phase timing shift of 180 degrees and at a different rocking speed.

3. The balance training apparatus as defined in claim 1, wherein:

the detector includes:

a first rotation plate provided on the first drive member, the first rotation plate having a first pit for detection of a zero degree phase timing of the first drive member;

a second rotation plate provided on the second drive member, the second rotation plate having a second pit for detection of a zero degree phase timing of the second drive member; and a mesh timing sensor drive circuit for detecting the zero degree phase timings and the rotational speeds of the first and second drive members based on the detection of the first and second pits.

4. The balance training apparatus as defined in claim 1, wherein the controller controls the transmission of the driving force from the first drive member to the second drive member to perform one of:

a first combination of the rocking motion about the first axis and the rocking motion about the second axis at the same phase;

a second combination of the rocking motion about the first axis and the rocking motion about the second axis at a phase timing shift of 90 degrees; and a third combination of the rocking motion about the first axis and the rocking motion about the second axis at a phase timing shift of 180 degrees.

* * * * *